US007909584B2

(12) United States Patent
Etter et al.

(10) Patent No.: US 7,909,584 B2
(45) Date of Patent: Mar. 22, 2011

(54) AIR COMPRESSOR

(75) Inventors: Mark A. Etter, Independence, MO (US); Timothy C. Smith, Jackson, TN (US); Robert P. Welsh, Phoenix, MD (US); John Buck, Cockeysville, MD (US); Fredrick M. Morgan, Jackson, TN (US); Chad W. Hanson, Jackson, TN (US); James Vintzel, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 1195 days.

(21) Appl. No.: 11/541,952

(22) Filed: Oct. 2, 2006

(65) Prior Publication Data

US 2007/0122292 A1 May 31, 2007

Related U.S. Application Data

(63) Continuation-in-part of application No. 11/048,639, filed on Jan. 31, 2005, now abandoned.

(60) Provisional application No. 60/540,755, filed on Jan. 30, 2004, provisional application No. 60/723,172, filed on Oct. 3, 2005.

(51) Int. Cl.
*F04B 53/00* (2006.01)
*F04B 35/06* (2006.01)

(52) U.S. Cl. ..... 417/234

(58) Field of Classification Search ..... 417/234
See application file for complete search history.

(56) References Cited

U.S. PATENT DOCUMENTS

| | | | | |
|---|---|---|---|---|
| 2,772,921 | A | 12/1956 | Nance | |
| 2,804,259 | A | 8/1957 | Ralston | |
| 2,826,354 | A | 3/1958 | Field | |
| D185,000 | S | 4/1959 | Hoover | |
| 3,433,415 | A | 3/1969 | Enssle | |
| D223,039 | S | 2/1972 | Widmer | |
| D243,282 | S | 2/1977 | Burenga | |
| 4,077,747 | A * | 3/1978 | Burenga | 417/234 |
| 4,089,655 | A | 5/1978 | Razete | |
| D273,011 | S | 3/1984 | Dudley | |
| 5,040,563 | A | 8/1991 | Wood | |
| 5,054,740 | A | 10/1991 | Wheeler | |
| D327,891 | S | 7/1992 | Morgan | |
| 5,137,434 | A | 8/1992 | Wheeler et al. | |
| 5,217,202 | A | 6/1993 | Phillips | |
| 5,217,238 | A | 6/1993 | Cyphers et al. | |
| 5,343,777 | A | 9/1994 | Wood et al. | |

(Continued)

FOREIGN PATENT DOCUMENTS

| | | |
|---|---|---|
| DE | 1 503 676 | 7/1966 |

(Continued)

*Primary Examiner* — Devon C Kramer
*Assistant Examiner* — Philip Stimpert
(74) *Attorney, Agent, or Firm* — Harness, Dickey & Pierce, P.L.C.

(57) ABSTRACT

An air compressor assembly can include a support structure with a compressor mechanism, at least one fluid tank, a pair of wheels, and a handle attached thereto. The air compressor assembly can be configured with the compressor mechanism having a perpendicular orientation relative to the at least one fluid tank so as to provide a relatively narrow assembly and to facilitate servicing and/or maintenance of the assembly. Furthermore, the wheels and handle can be configured so that the assembly can be relatively easily located in a balanced transport position. Additionally, an accessory support plate can be attached to the top of the assembly to serve as a dolly.

29 Claims, 20 Drawing Sheets

U.S. PATENT DOCUMENTS

| | | | | |
|---|---|---|---|---|
| D352,292 | S | 11/1994 | Morgan | |
| D352,293 | S | 11/1994 | Morgan | |
| D352,294 | S | 11/1994 | Morgan | |
| D352,295 | S | 11/1994 | Morgan | |
| 5,419,497 | A | 5/1995 | Warrington | |
| 5,584,675 | A | 12/1996 | Steurer et al. | |
| 5,681,151 | A | 10/1997 | Wood | |
| D423,518 | S | 4/2000 | Milligan et al. | |
| 6,183,211 | B1 | 2/2001 | Wood | |
| 6,213,000 | B1 | 4/2001 | Wood | |
| D444,796 | S | 7/2001 | Morgan | |
| D450,061 | S | 11/2001 | Graber et al. | |
| 6,349,630 | B1 | 2/2002 | Wood | |
| 6,375,437 | B1 * | 4/2002 | Nolan | 417/234 |
| D461,196 | S | 8/2002 | Buck | |
| 6,468,048 | B1 | 10/2002 | Burkholder et al. | |
| 6,471,488 | B2 * | 10/2002 | Nolan | 417/63 |
| D471,918 | S | 3/2003 | Buck | |
| 6,532,990 | B1 | 3/2003 | Wood et al. | |
| 6,532,991 | B1 | 3/2003 | Wood et al. | |
| 6,558,135 | B1 | 5/2003 | Wood | |
| 6,582,201 | B2 | 6/2003 | Lucchi | |
| D479,248 | S | 9/2003 | Gist et al. | |
| 6,655,925 | B1 | 12/2003 | Robenalt et al. | |
| D488,485 | S | 4/2004 | Leasure et al. | |
| D489,733 | S | 5/2004 | Leasure et al. | |
| D491,197 | S | 6/2004 | Stilwell et al. | |
| 6,742,995 | B1 | 6/2004 | Wood et al. | |
| 6,773,237 | B2 | 8/2004 | Burford et al. | |
| D498,244 | S | 11/2004 | Chen | |
| D499,117 | S | 11/2004 | Leasure et al. | |
| D499,118 | S | 11/2004 | Leasure et al. | |
| D499,429 | S | 12/2004 | Leasure | |
| D499,433 | S | 12/2004 | Leasure | |
| D500,050 | S | 12/2004 | Lucchi | |
| D500,052 | S | 12/2004 | Lucchi | |
| D502,810 | S | 3/2005 | Morgan et al. | |
| 6,892,921 | B2 | 5/2005 | Beville | |
| D508,497 | S | 8/2005 | Leasure et al. | |
| 6,923,364 | B2 | 8/2005 | Burkholder et al. | |
| 6,923,627 | B1 | 8/2005 | Wood et al. | |
| 6,942,464 | B2 | 9/2005 | Brashears et al. | |
| 7,029,240 | B2 | 4/2006 | Baron et al. | |
| 2002/0131872 | A1 * | 9/2002 | Lucchi | 417/234 |
| 2003/0180156 | A1 | 9/2003 | Brashears et al. | |
| 2004/0028535 | A1 | 2/2004 | Brashears et al. | |
| 2005/0196290 | A1 | 9/2005 | Hu | |
| 2006/0140784 | A1 | 6/2006 | Baron et al. | |

FOREIGN PATENT DOCUMENTS

| | | | |
|---|---|---|---|
| DE | 81 00434.6 | U1 | 7/1981 |
| DE | 86 24 842.1 | | 9/1986 |
| DE | 92 11 451.2 | | 8/1992 |
| DE | 197 08 191 | A1 | 2/1997 |
| DE | 297 21 504 | U1 | 12/1997 |
| DE | 299 05 869 | U1 | 3/1999 |
| DE | 101 47 400 A 1 | | 9/2001 |
| WO | WO 2004/033904 | A2 | 4/2004 |

* cited by examiner

AIR COMPRESSOR

CROSS-REFERENCE TO RELATED APPLICATIONS

This application is a continuation-in-part of U.S. patent application Ser. No. 11/048,639, filed on Jan. 31, 2005 now abandoned, which claims the benefit of U.S. Provisional Application No. 60/540,755, filed on Jan. 30, 2004. This application also claims the benefit of U.S. Provisional Application No. 60/723,172, filed on Oct. 3, 2005. The disclosures of these applications are incorporated herein by reference.

FIELD

This disclosure relates to air compressors and, more particularly, to portable air compressor assemblies.

BACKGROUND

Portable air compressors are intended to be transported between different job sites. Accordingly, it would be desirable for a portable air compressor to have a relatively compact width and to be relatively easy to pivot between operational and transport positions.

Furthermore, when transporting the air compressor amongst the different job sites, it may be necessary to transport other items in support of the intended task to be completed using the air compressor. For example, accessories for the compressor, such as hoses or nozzles, power tools which may be driven by the compressor and/or other suitable construction materials may need to be transported to a job site. It is envisioned that the air compressor assembly may be modified to accommodate transportation of these types of items.

Additionally, it would be desirable for a portable air compressor to facilitate the servicing and/or maintenance thereof.

The statements in this section merely provide background information related to this disclosure and may not constitute prior art.

SUMMARY

An air compressor assembly is provided. The air compressor assembly can include a support structure having a back portion and a top portion and side portions extending forwardly from the back portion. The air compressor assembly can further include a handle attached to the support structure and a pair of wheels transversely spaced apart and rotatably attached to the support structure at opposing positions proximate the side portions. The wheels can be pivotable about a single rotational axis extending transversely across the support structure. The air compressor assembly can further include at least one fluid tank having a tank longitudinal axis defined therein. The at least one fluid tank can be secured to the support structure with the tank longitudinal axis parallel to the rotational axis of the wheels. The air compressor assembly can also include a compressor mechanism secured to the support structure proximate the at least one fluid tank. The compressor mechanism can have a compressor longitudinal axis defined therein and can be oriented on the support structure between the side portions with the compressor longitudinal axis substantially perpendicular to the tank longitudinal axis.

This disclosure further provides another air compressor assembly. The air compressor assembly can include a support structure having a pair of frame members. Each of the frame members can have a rearward facing section and upper and lower sections extending forwardly from the rearward facing section. The support structure can further include a front member extending between the lower sections of the frame members opposite the rearward facing sections. The air compressor assembly can further include a handle attached to the support structure proximate the rearward facing sections of the frame members, at least one fluid tank secured to the support structure, and a compressor mechanism secured to the support structure. The air compressor assembly can also include a pair of wheels pivotable about a single rotational axis. The wheels can be rotatably attached to the support structure at opposing positions proximate the lower sections of the frame members and in between the rearward facing sections of the frame members and the front member of the support structure so that the rotational axis is forward of said handle. The air compressor assembly can have an operational position in which the air compressor assembly is supported by the wheels and the front member of the support structure. Additionally, the air compressor assembly is pivotable from the operational position about the rotational axis of the wheels to a transport position in which the air compressor is supported only by the wheels so as to be movable.

This disclosure further provides another air compressor assembly. The air compressor assembly can include a support structure having a pair of frame members. Each of the frame members can have a rearward facing section and upper and lower sections extending forwardly from the rearward facing section. The air compressor assembly can further include a handle attached to the support structure proximate the rearward facing sections of the frame members, at least one fluid tank secured to the support structure, a compressor mechanism secured to the support structure, and a pair of wheels rotatably attached to the support structure at opposing positions proximate the lower sections of the frame members. The air compressor assembly can also include an accessory support plate secured to the support structure in between the upper sections of the frame members. The accessory support plate can have a pair of first apertures and a pair of second apertures formed therein. The first apertures can be transversely spaced and disposed proximate the rearward facing sections of the frame members, and the second apertures can be disposed forward of the first apertures. Each of the second apertures can be transversely aligned with one of the first apertures. The first and second apertures can be adapted for removably engaging with securing mechanisms for securing items on the accessory support plate.

Further areas of applicability will become apparent from the description provided herein. It should be understood that the description and specific examples are intended for purposes of illustration only and are not intended to limit the scope of the present disclosure.

DRAWINGS

FIG. 1 is a perspective view of an air compressor assembly according to the principles of the present disclosure;

FIGS. 2A, 2B, and 2C are side views of the air compressor assembly of FIG. 1 in an operational position, an exemplary transport position, and a drain position, respectively;

Figure 1:
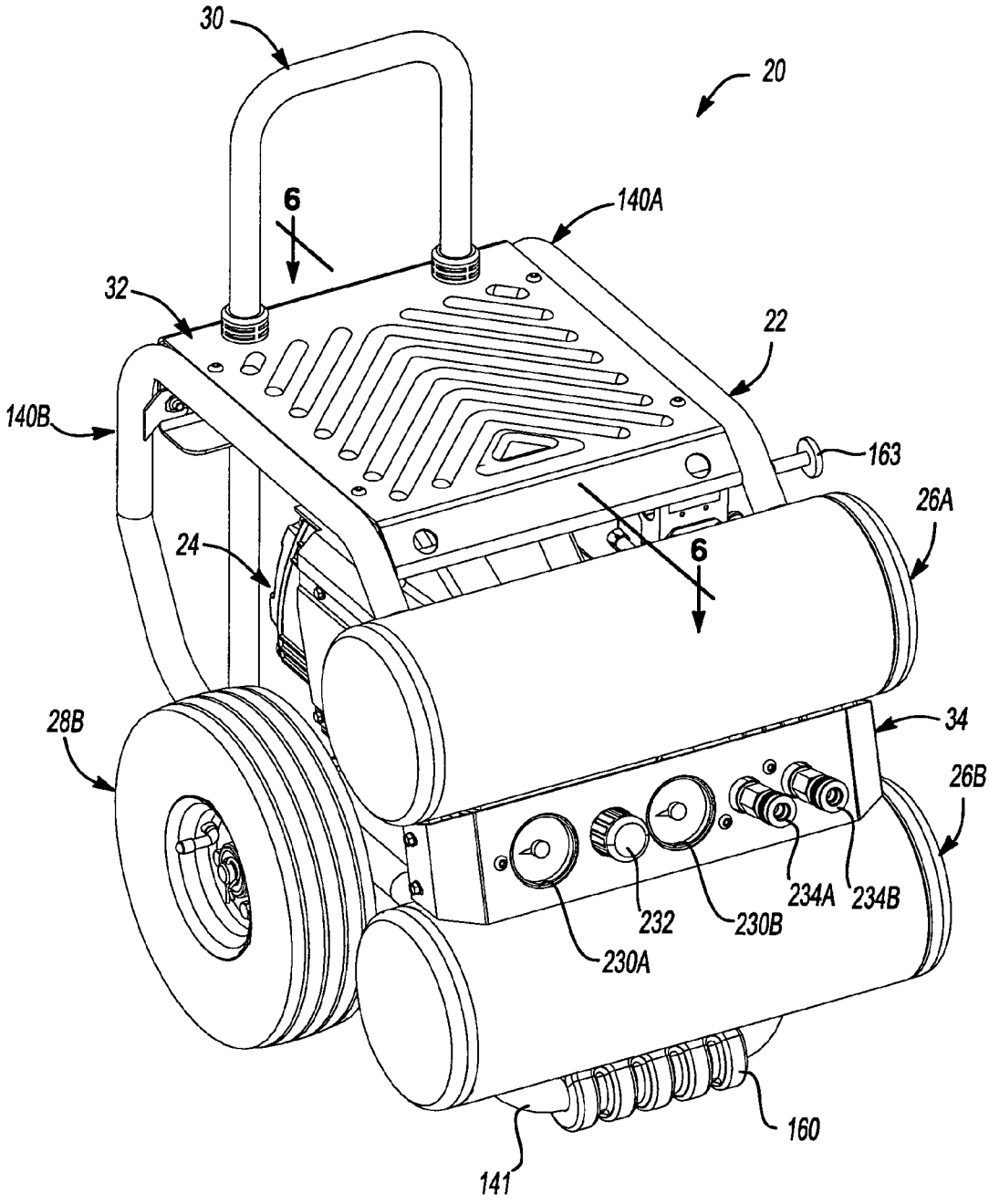

The drawings described herein are for illustration purposes only and are not intended to limit the scope of this disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features. For example, corresponding components can be indicated by the similar reference numerals 19, 1019, and 2019.

An air compressor assembly can include a support structure with a compressor mechanism, at least one fluid tank, a pair of wheels, and a handle attached thereto. The air compressor assembly can be configured with the compressor mechanism having a perpendicular orientation relative to the at least one fluid tank so as to provide a relatively narrow assembly and to facilitate servicing and/or maintenance of the assembly. Furthermore, the wheels and handle can be configured so that the assembly can be relatively easily located in a balanced transport position. Additionally, an accessory support plate can be attached to the top of the assembly to serve as a dolly.

FIGS. 1-6 illustrate an exemplary air compressor assembly 20. Air compressor assembly 20 includes a support structure 22 and a compressor mechanism 24, a pair of fluid tanks 26A, 26B, a pair of wheels 28A, 28B, a handle 30, an accessory support plate 32, and a control panel 34 attached to support structure 22.

Air compressor assembly 20 can have a compressor mechanism that is conventional in its construction and operation. As such, referring in particular to FIGS. 2A, 3A, compressor mechanism 24 includes a compressor 36 and a power source 38. Compressor 36 is operable for intaking and compressing ambient air. Power source 38 can be, for example, an electric motor or an engine, and provides power to the compressor 36. The compressed air that exits the compressor 36 is discharged to fluid tanks 26A, 26B which are in fluid communication with one another and can serve as a reservoir for the compressed air.

Compressor mechanism 24 can have a generally rectangular or elongated shape with a greater length than height or width. Compressor mechanism 24 has a compressor longitudinal axis 80 defined along the length thereof. Furthermore, compressor mechanism 24 includes a first end 82 and a second end 84. First end 82 can be defined along compressor longitudinal axis 80, and second end 84 can be defined opposite first end 82. Additionally, compressor mechanism 24 includes an oil drain 86, which can be positioned proximate first end 82.

Figure 5:
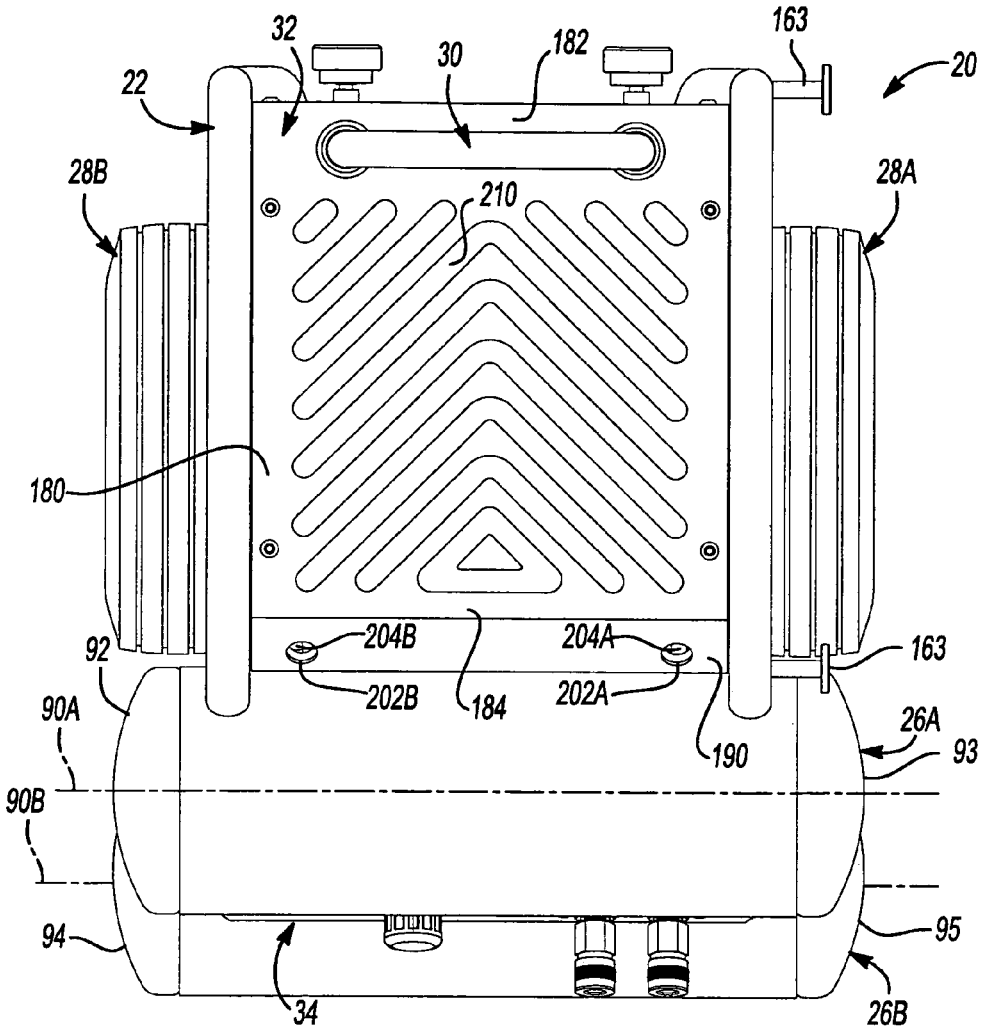
FIG. 5 is a top view of the air compressor assembly of FIG. 1.

Referring in particular of FIG. 5, fluid tanks 26A, 26B can have a generally elongated cylindrical shape. Fluid tanks 26A, 26B have tank longitudinal axes 90A, 90B defined along the length thereof, respectively. Furthermore, fluid tank 26A includes first and second ends 92, 93 which can be defined along tank longitudinal axis 90A, and fluid tank 26B includes first and second ends 94, 95 which can be defined along tank longitudinal axis 90B.

Fluid tanks 26A, 26B include a fluid drain 96 (FIG. 3A), which can be disposed on fluid tank 26B between first and second ends 94, 95. As fluid tanks 26A, 26B are in fluid communication with one another, fluid drain 96 is selectively operable to allow liquid to drain from both fluid tanks 26A, 26B. As shown in the Figures, fluid drain 96 can be angled between a rearward direction and a downward direction. As used herein, the terms "rearward" and "forward" refer to directions substantially parallel to a fore and aft centerline of an assembly. Furthermore, as used herein, the terms "downward" and "vertical" refer to directions substantially perpendicular to a fore and aft centerline of an assembly extending along the height of an assembly. Additionally, as used herein, the term "transverse" refers to a direction substantially perpendicular to a fore and aft centerline of an assembly extending along the width of an assembly.

Figure 3A:
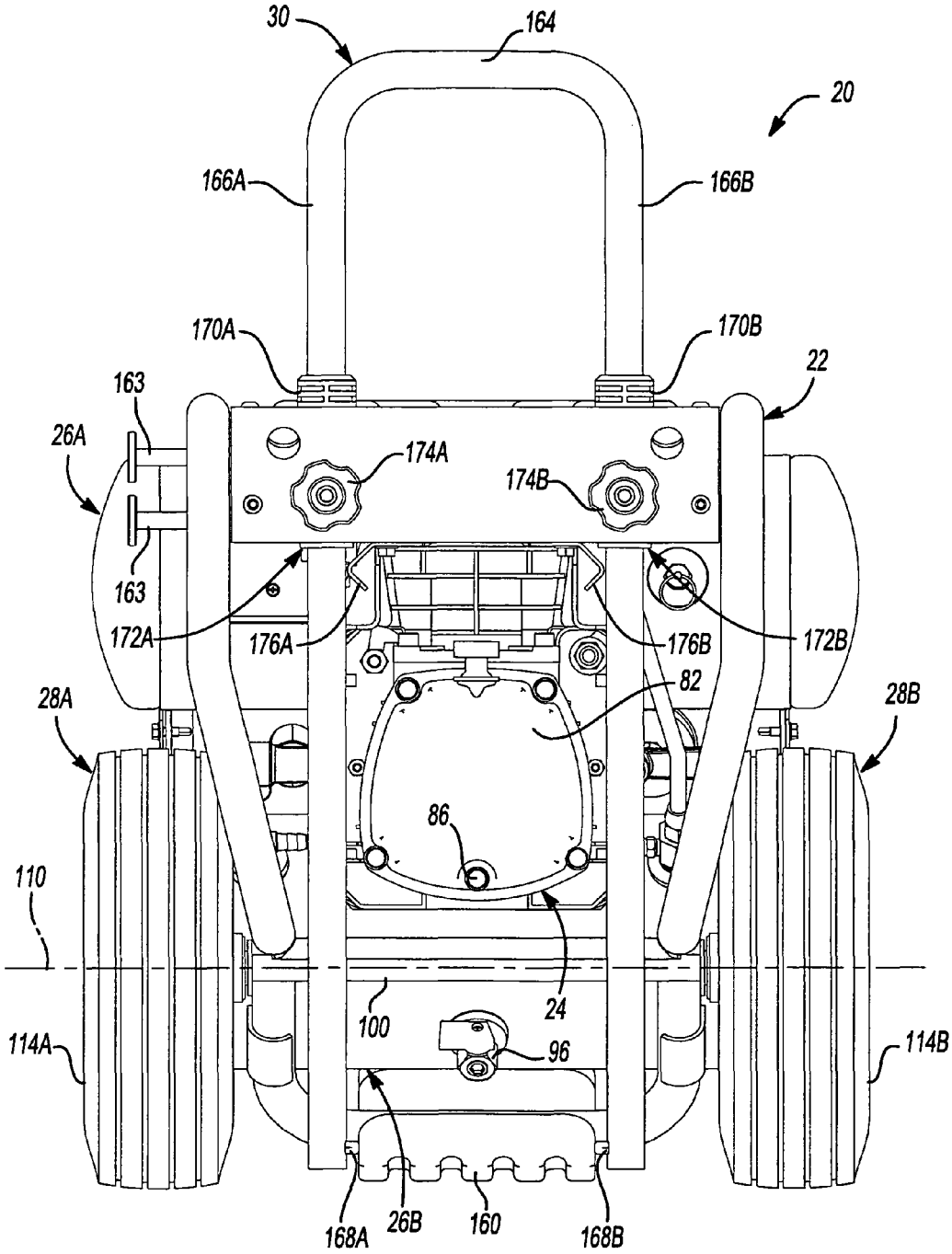
FIGS. 3A and 3B are rear views of the air compressor assembly of FIG. 1 with a handle in retracted and extended positions, respectively.

Referring in particular of FIG. 3A, wheels 28A, 28B are rotatably attached to support structure 22 at opposing positions. In particular, wheels 28A, 28B are attached to opposite ends of an axle 100 and spaced apart along a transverse direction. As such, wheels 28A, 28B are aligned to rotate about a single rotational axis 110. Additionally, wheel 28A has an outside surface 114A which faces away from wheel 28B, and wheel 28B has an outside surface 114B which faces away from wheel 28A.

Figure 4:
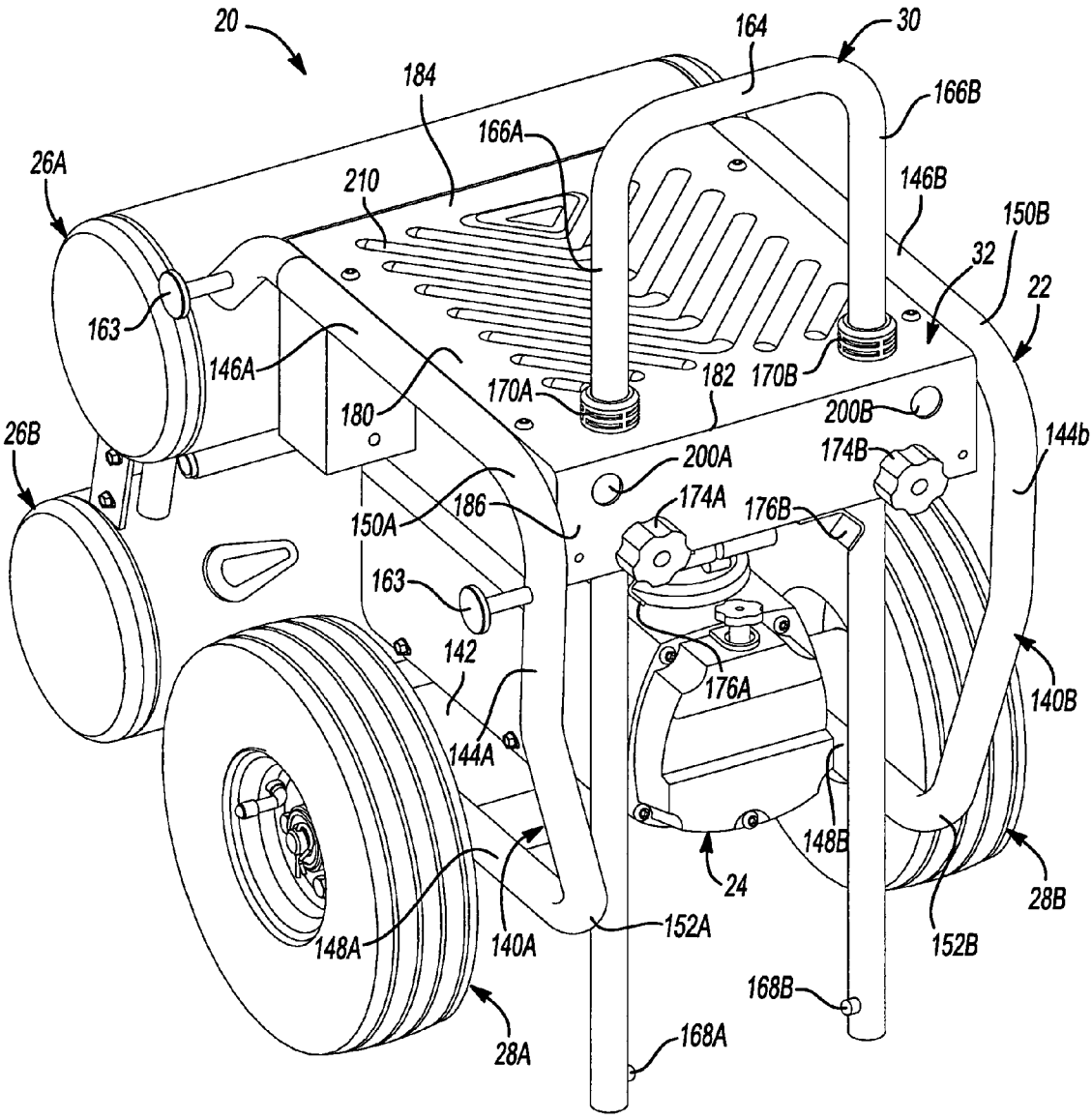
FIG. 4 is another perspective view of the air compressor assembly of FIG. 1.

Support structure 22 of air compressor assembly 20 can be configured in a "roll-cage" manner to extend around an outer envelope defined by compressor mechanism 24 and protect its components should the air compressor assembly 20 be overturned or impacted by another object. Generally, support structure 22 can have a back portion, top and side portions extending forwardly from the back portion, and a forward portion. Referring in particular to FIGS. 1 and 4, exemplary support structure 22 includes a pair of frame members 140A, 140B, a front member 141, and a mounting plate 142.

Frame members 140A, 140B of support structure 22 are u-shaped tubular members oriented opposite to each other and having rearward facing sections 144A, 144B, upper sections 146A, 146B, and lower sections 148A, 148B. Rearward facing sections 144A, 144B and upper sections 146A, 146B are joined at upper elbows 150A, 150B, respectively. Rearward facing sections 144A, 144B and lower sections 148A, 148B are joined at lower elbows 152A, 152B, respectively. Furthermore, upper sections 146A, 146B and lower sections 148A, 148B extend forwardly from upper elbows 150A, 150B and lower elbows 152A, 152B, respectively, such that the open end of the u-shaped tubular frame members 140A, 140B is forward facing.

Each of rearward facing sections 144A, 144B, upper sections 146A, 146B, and lower sections 148A, 148B of frame members 140A, 140B can be contoured. For example, forward facing ends of upper sections 146A, 146B and lower sections 148A, 148B of frame members 140A, 140B may be angled downward to provide for a sloped front facing for the air compressor assembly 20. It should be understood that these features are exemplary and that frame members 140A, 140B can vary. Furthermore, while support structure 22 employs u-shaped frame members 140A, 140B, it is readily understood that other frame configurations and shapes which define an upper and lower section are within the broader aspects of this disclosure.

Front member 141 of support structure 22 is horizontally disposed between lower sections 148A, 148B of frame members 140A, 140B. In particular, front member 141 extends between the forward facing ends of lower sections 148A, 148B. Furthermore, a foot 160 may be attached to front member 141 for engaging a surface 162 which supports the assembly during operation as described in further detail below. Foot 160 may be made of, for example, rubber or plastic. As shown in the Figures, foot 160 may be sized so as to be in close contact with fluid tank 26B.

Mounting plate 142 of support structure 22 is also horizontally disposed between lower sections 148A, 148B of frame members 140A, 140B. In particular, mounting plate 142 can be mechanically joined (e.g., welded) to lower sections 148A, 148B.

Additionally, support structure 22 can include posts 163 extending outwardly from frame member 140A. Posts 163 can be used to wrap and store cords (not shown) for air compressor assembly 20.

As noted above, components of air compressor assembly 20 can be attached to support structure 22. In particular, support structure 22 can support compressor mechanism 24, fluid tanks 26A, 26B, and wheels 28A, 28B in a desired orientation for ease of use and transportability of air compressor assembly 20. The exemplary configuration of air compressor assembly 20 illustrated in the Figures includes the components of air compressor assembly 20 in such a desired orientation.

In the exemplary configuration of air compressor assembly 20, compressor mechanism 24 is supported by and attached to mounting plate 142 of support structure 22. In particular, compressor mechanism 24 is attached to support structure 22 with compressor longitudinal axis 80 substantially perpendicular to a transverse direction extending across air compressor assembly 20. Furthermore, first end 82 of compressor mechanism 24 is positioned proximate rearward facing sections 144A, 144B of frame members 140A, 140B with oil drain 86 positioned in between the rearward facing sections 144A, 144B. Accordingly, oil drain 86 is accessible to a user of air compressor assembly 20. Additionally, a space is provided underneath first end 82 of compressor mechanism 24, thereby permitting a drain pan to be more easily positioned underneath oil drain 86 to further facilitate maintenance and/or service of compressor mechanism 24.

Also in the exemplary configuration of air compressor assembly 20, fluid tanks 26A, 26B are supported by and attached to frame members 140A, 140B of support structure 22. In particular, fluid tank 26A can be mechanically joined to the forward facing end of upper sections 146A, 146B of frame members 140A, 140B, and fluid tank 26B can be mechanically joined to upper surfaces of the downwardly angled lower sections 148A, 148B of frame members 140A, 140B. Furthermore, fluid tanks 26A, 26B are configured with tank longitudinal axes 90A, 90B substantially parallel to each other as well as substantially parallel to a transverse direction extending across air compressor assembly 20. Therefore, air compressor assembly 20 includes compressor longitudinal axis 80 oriented substantially perpendicular to tank longitudinal axes 90A, 90B.

Additionally, fluid tanks 26A, 26B are centered along tank longitudinal axes 90A, 90B relative to frame members 140A, 140B. As such, fluid drain 96 is positioned between lower sections 148A, 148B of frame members 140A, 140B. Accordingly, fluid drain 96 is also accessible to a user of air compressor assembly 20 to further facilitate maintenance and/or service thereof.

Furthermore, in the exemplary configuration of air compressor assembly 20, wheels 28A, 28B are attached to support structure 22 via axle 100, which is attached to lower sections 148A, 148B of frame members 140A, 140B. Axle 100 can be attached in a variety of ways, for example, welding, belting, and joining by adhesive. Moreover, wheels 28A, 28B are attached to support structure 22 such that rotational axis 110 is substantially parallel to a transverse direction extending across air compressor assembly 20 and substantially parallel to tank longitudinal axes 90A, 90B. Therefore, rotational axis 110 is also substantially perpendicular to compressor longitudinal axis 80.

Figure 3B:
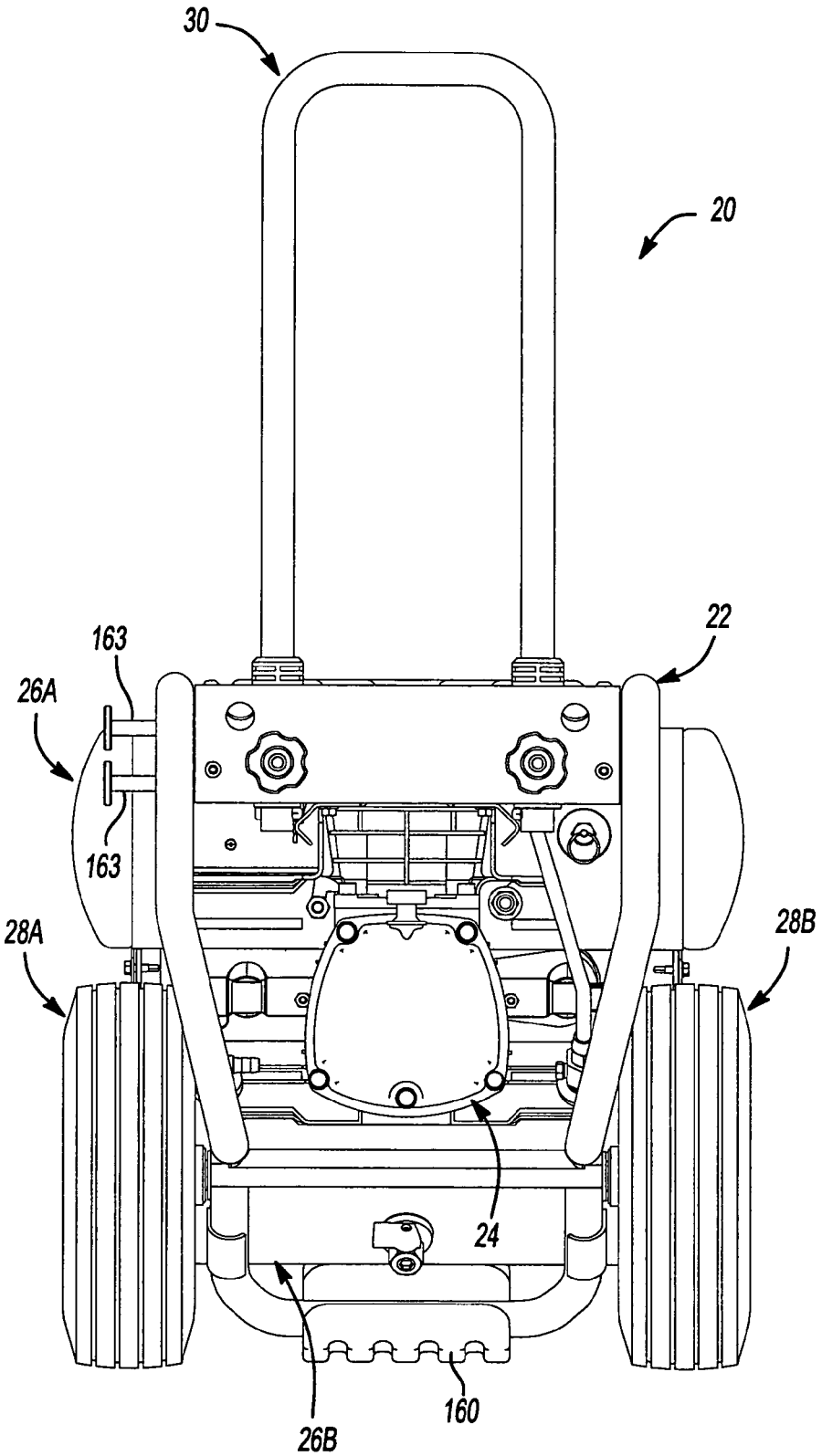

With compressor mechanism 24 oriented perpendicularly relative to fluid tanks 26A, 26B as described above, wheels 28A, 28B can be positioned proximate compressor mechanism 24 to provide for a narrow width of air compressor assembly 20. With such an arrangement, a shorter axle 100 may be employed, thereby resulting in a narrower width for air compressor assembly 20. For example, wheels 28A, 28B can be positioned to align outside surfaces 114A, 114B thereof with the ends of fluid tanks 26A, 26B (FIGS. 3A, 3B). As such, the width of exemplary air compressor assembly 20 can be reduced to the width of fluid tanks 26A, 26B.

Air compressor assembly 20 includes handle 30 which may be used to pivot air compressor assembly 20 to transport and drain positions, as described in further detail below. Handle 30 may telescope to provide a more compact assembly when not in use. Handle 30 is an inverted unshaped tubular member attached to support structure 22 proximate rearward facing sections 144A, 144B of frame members 140A, 140B. Referring in particular to FIGS. 3A and 4, handle 30 includes a main section 164 adapted for the grip of a user of air compressor assembly 20 and two side sections 166A, 166B extending downwardly from main section 164. Furthermore, handle 30 includes two pins 168A, 168B disposed proximate ends of side sections 166A, 166B, respectively, and extending inwardly towards each other.

Handle 30 can be positioned in between rearward facing sections 144A, 144B of frame members 140A, 140B and rotational axis 110 of wheels 28A, 28B. In particular, handle 30 can be rearward of the entire wheels 28A, 28B. With handle 30 forward of rearward facing sections 144A, 144B, handle 30 can extend through accessory support plate 32 and, along with accessory support plate 32, can support items when air compressor assembly 20 is in a transport position, as described in more detail below. Furthermore, with wheels 28A, 28B forward of rearward facing sections 144A, 144B of frame numbers 140A, 140B and handle 30, rotational axis 110 of wheels 28A, 28B is disposed proximate the center of mass of air compressor assembly 20. Therefore, it can be relatively easier for a user to manipulate handle 30 and locate air compressor assembly 20 in a transport position, as described in more detail below.

Air compressor assembly 20 includes a pair of first bushings 170A, 170B and a pair of second bushings 172A, 172B supported in accessory support plate 32. Sides sections 166A, 166B of handle 30 extend through these bushings and have a frictional engagement therewith. As such, first bushings 170A, 170B and second bushings 172A, 172B can inhibit undesired telescoping of handle 30. The bushings also orient handle 30 relative to support structure 22. For example, in a retracted position (FIG. 3A), side sections 166A, 166B of handle 30 extend along rearward facing sections 144A, 144B.

Air compressor assembly 20 also includes knobs 174A, 174B rotatably supported by accessory support plate 32. Knobs 174A, 174B can be disposed in between first bushings 170A, 170B and second bushings 172A, 172B. Knobs 174A, 174B are operable to engage with side sections 166A, 166B of handle 30 and maintain a position of handle 30. In particular, knobs 174A, 174B can have rubber on the inside ends thereof (not shown) to provide for an enhanced frictional engagement with side sections 166A, 166B of handle 30. For example, a user of air compressor assembly 20 can locate handle 30 in a desired position and turn the knobs 174A, 174B to tighten the ends thereof against side sections 166A, 166B, respectively. Thereby, handle 30 can be maintained in the desired position.

Air compressor assembly 20 further includes brackets 176A, 176B. Brackets 176A, 176B are attached to accessory support plate 32 and extend along side sections 166A, 166B of handle 30, respectively. Brackets 176A, 176B are disposed proximate side sections 166A, 166B so that pins 168A, 168B must engage with and displace brackets 176A, 176B in order for handle 30 to be located in a fully extended position, in which pins 168A, 168B are between brackets 176A, 176B and accessory support plate 32 (FIG. 3B). With handle 30 in the fully extended position, brackets 176A, 176B can return to positions proximate side sections 166A, 166B. Therefore, to move handle 30 from the fully extended position, brackets 176A, 176B again must be displaced away from side sections 166A, 166B. As such, the brackets 176A, 176B can operate to inhibit handle 30 from unwanted displacement from the fully extended position.

Figure 2A:
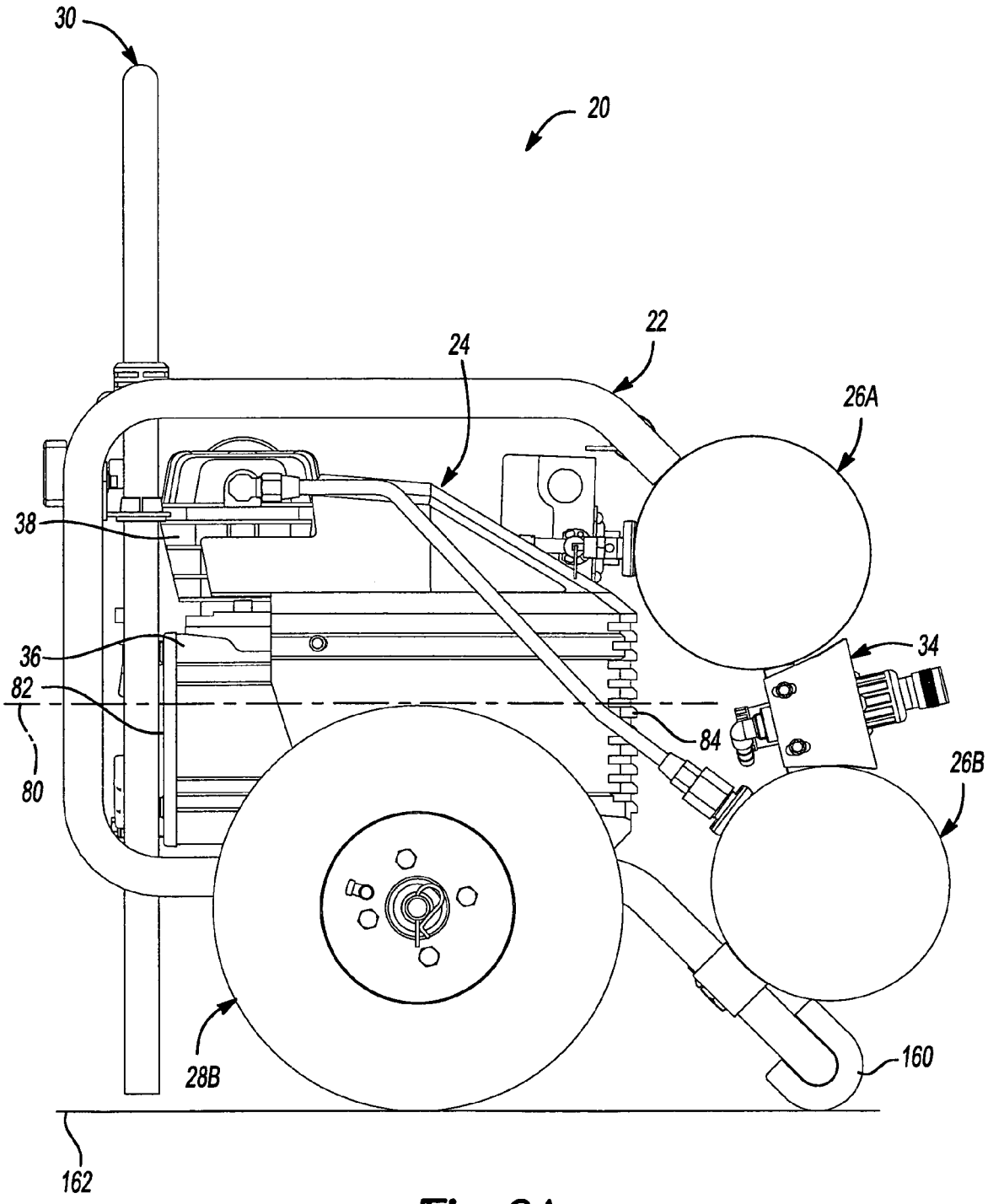
Figure 2B:
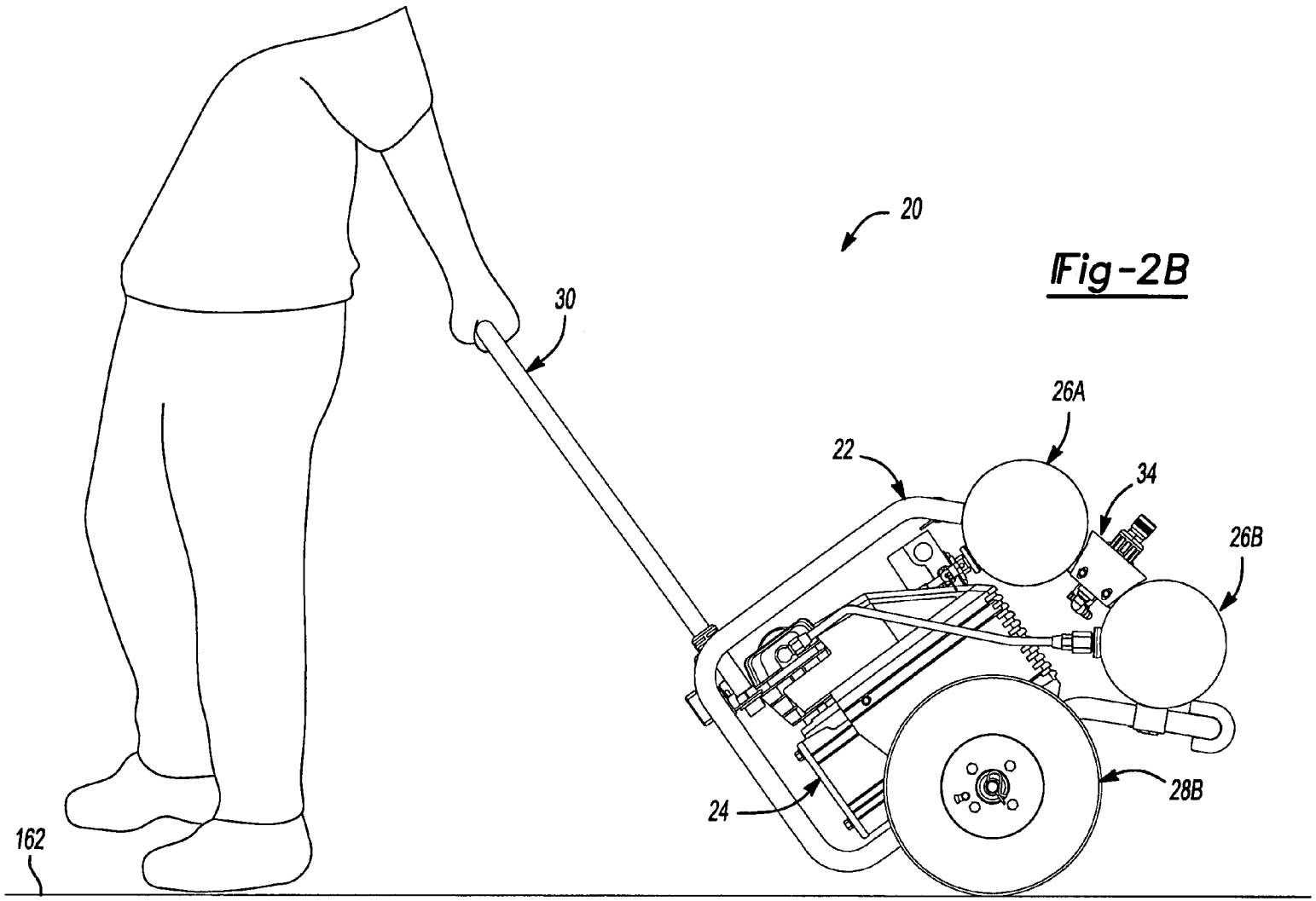
Figure 2C:
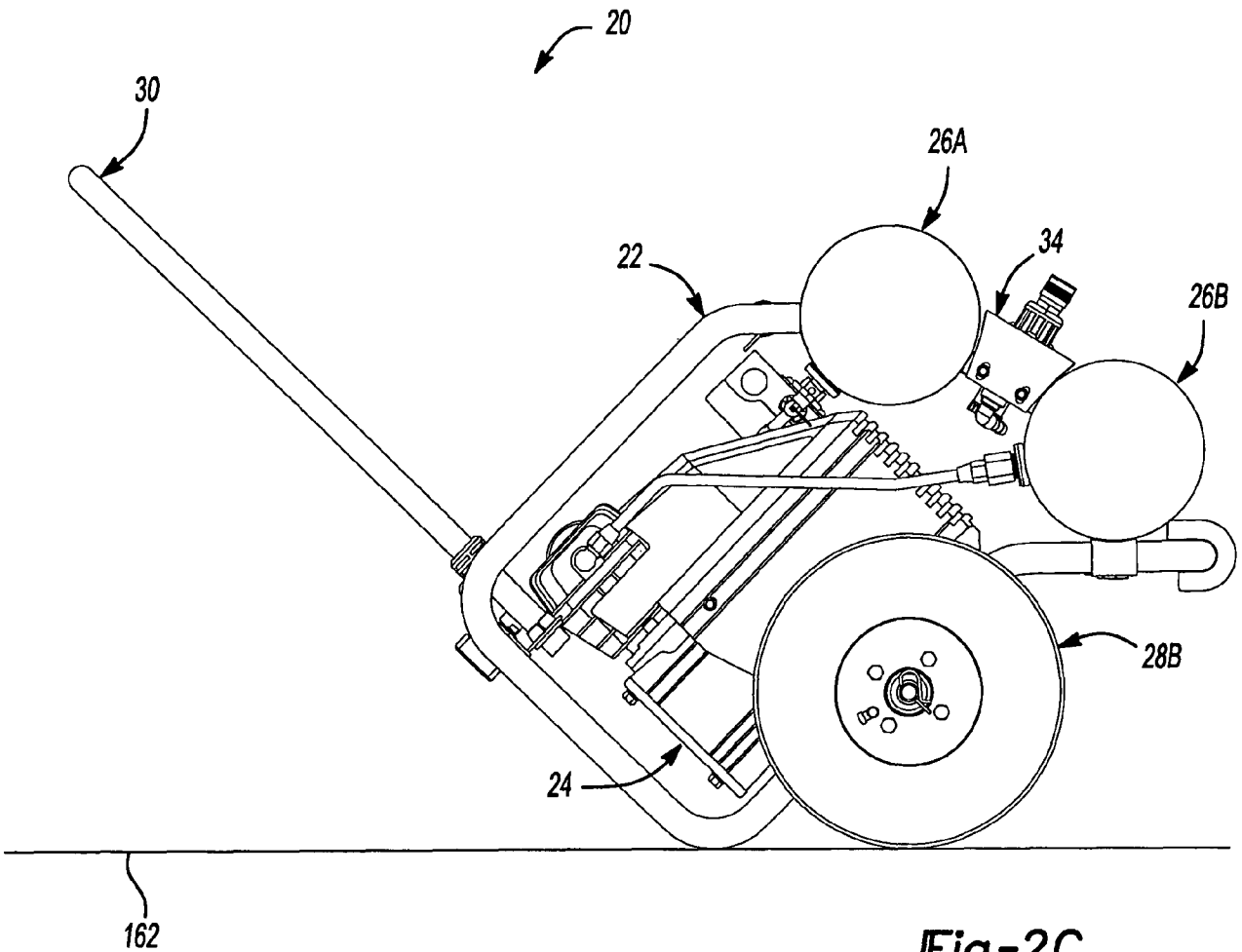

Referring in particular to FIGS. 2A-2C, according to the principles of the present disclosure, an air compressor assembly 20 can have an operation position, a transport position, and a drain position.

In an exemplary operational position (FIG. 2A), wheels 28A, 28B and front member 141 of support structure 22 engage a surface 162 which supports the air compressor assembly 20, such that accessory support plate 32 and mounting plate 142 are substantially parallel to surface 162. Air compressor assembly 20 is stably supported and can be operated. Furthermore, as is best shown in FIG. 4, there is space underneath compressor mechanism 24 in this position so as to provide accessibility for service and/or maintenance of compressor mechanism 24.

In an exemplary transport position (FIG. 2B), air compressor assembly 20 is pivoted about rotational axis 110 of wheels 28A, 28B from the operational position. In particular, a user can operate handle 30 to a fully extended position and pivot air compressor assembly 20 so that front member 141 of support structure 22 moves away from surface 162. Therefore, air compressor assembly 20 is supported on surface 162 only by wheels 28A, 28B and can be moved along surface 162 on wheels 28A, 28B.

With compressor mechanism 24 oriented perpendicular to fluid tanks 26A, 26B and wheels 28A, 28B positioned forward of handle 30, rotational axis 110 can be positioned proximate the center of mass of air compressor assembly 20. As such, air compressor assembly 20 can require relatively less pivoting from an operational position to a transport position in which the weight of air compressor assembly 20 is balanced over rotational axis 110 of wheels 28A, 28B. Therefore, air compressor assembly 20 can be relatively easier to pivot into a balanced transport position than a conventionally configured air compressor assembly.

In an exemplary drain position (FIG. 2C), air compressor assembly is supported on surface 162 by wheels 28A, 28B and lower elbows 152A, 152B of support structure 22. With the center of mass of air compressor assembly 20 and rotational axis 110 positioned proximate each other as described above, air compressor assembly 20 can stably maintain the drain position.

The drain position can facilitate operation of oil drain 86 of compressor mechanism 24 and fluid drain 96 of fluid tanks 26A, 26B. In the drain position, both oil drain 86 and fluid drain 96 can be oriented towards a downward direction. For example, fluid drain 96 can be configured so as to be substantially vertical when air compressor assembly 20 is in the drain position. Therefore, both oil drain 86 and fluid drain 96 can be relatively easy to operate and can operate relatively quickly and efficiently.

Air compressor assembly 20 also includes accessory support plate 32. Accessory support plate 32 is mounted onto the top of support structure 22. In particular, accessory support plate 32 is secured to upper sections 146A, 146B of frame members 140A, 140B. Accessory support plate 32 can be secured to support structure 22 in a variety of ways, such as by welding, screws, rivets, and/or other types of fasteners.

Figure 6:
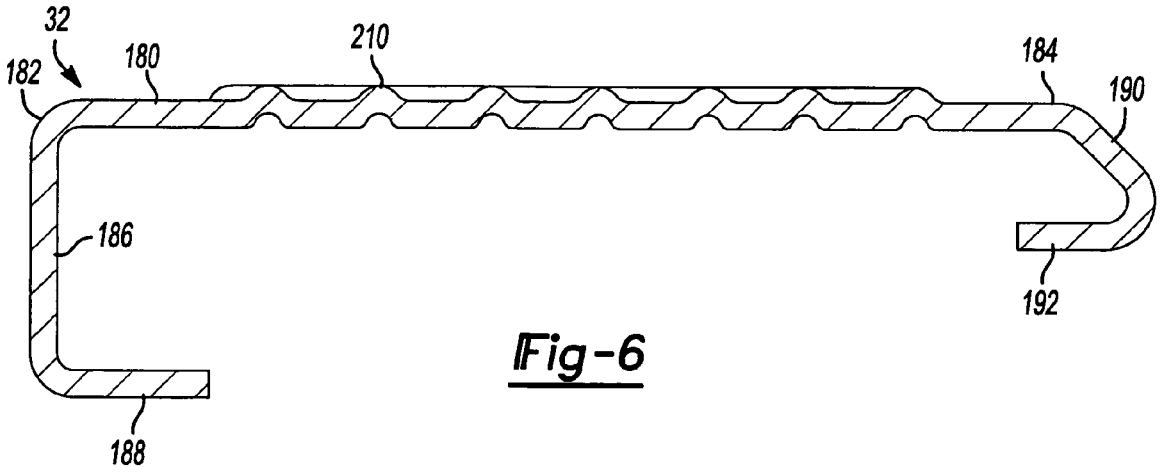
FIG. 6 is a cross-sectional view of an accessory support plate of the air compressor assembly of FIG. 1 along the line 6-6 shown in FIG. 1.

Referring in particular to FIGS. 4-6, accessory support plate 32 has a plurality of portions including a main portion 180. Main portion 180 has a generally flat, rectangular shape with a first end 182 and a second end 184. Accessory support plate 32 can be oriented so that first end 182 of main portion 180 is disposed proximate rearward facing sections 144A, 144B of frame members 140A, 140B and second end 184 of main portion 180 is disposed opposite first end 182. Accessory support plate 32 includes a rear portion 186. Rear portion 186 extends downwardly from first end 182 of main portion 180 between rearward facing sections 144A, 144B of frame members 140A, 140B. Accessory support plate 32 also includes a bottom portion 188 extending forwardly from rear portion 186. In particular, bottom portion 188 can extend substantially parallel to main portion 180 from an end of rear portion 186 opposite main portion 180.

Accessory support plate 32 further includes an angled portion 190 extending from second end 184 of main portion 180. Angled portion 190 can be oriented between a downward direction and a forward direction. Accessory support plate 32 also includes a grip portion 192 extending rearwardly from angled portion 190. In particular, grip portion 192 can extend substantially parallel to main portion 180 from an end of angled portion 190 opposite main portion 180. Angled portion 190 and grip portion 192 can be configured for use as an auxiliary handle of air compressor assembly 20.

As explained above, handle 30 can extend through accessory support plate 32. Furthermore, as also explained above, accessory support plate 32 can support first bushings 170A, 170B, second bushings 172A, 172B, knobs 174A, 174B, and brackets 176A, 176B. In particular, first bushings 170A, 170B can be disposed in main portion 180, second bushings 172A, 172B can be disposed in bottom portion 188, and side sections 166A, 166B of handle 30 can extend through the bushings. Knobs 174A, 174B can be attached to rear portion 186. Additionally, brackets 176A, 176B can be attached to a downward facing surface of bottom portion 188.

Accessory support plate 32 has a plurality of apertures formed therein which are adapted to removably engage with a variety of securing mechanisms for securing items on accessory support plate 32. Accessory support plate 32 includes a pair of first apertures 200A, 200B formed in rear portion 186. First apertures 200A, 200B can be transversely spaced apart from each other proximate frame members 140A, 140B, respectively. Furthermore, first apertures 200A, 200B can be vertically aligned with each other. Accessory support plate 32 also includes a pair of second apertures 202A, 202B formed in angled portion 190. Second apertures 202A, 202B can be transversely spaced apart from each other proximate frame members 140A, 140B, respectively. Second apertures 202A, 202B can also be vertically aligned with each other. Furthermore, first apertures 200A, 200B and second apertures 202A, 202B can be aligned along a forward direction (FIGS. 3A, 3B)

Accessory support plate 32 can further include a pair of third apertures 204A, 204B formed in grip portion 192. Third apertures 204A, 204B can be transversely spaced apart from each other and aligned with each other along a forward direction. Furthermore, third apertures 204A, 204B can be aligned with second apertures 202A, 202B along a vertical direction (FIG. 5).

Additionally, accessory support plate 32 includes a plurality of protrusions 210 extending outwardly from a top surface 212 of main portion 180. Protrusions 210 can strengthen accessory support plate 32 and can also help maintain the position of an item disposed on accessory support plate 32 as described below.

When transporting air compressor assembly 20 as described above, items which may otherwise be carried by hand, such as hoses, tools, construction supplies, etc., may be placed onto accessory support plate 32. In this way, accessory support plate 32 of air compressor assembly 20 serves as a dolly. In particular, as handle 30 extends through main portion 180 of accessory support plate 32, items can be supported between handle 30 and accessory support plate 32 when air compressor assembly 20 is in a transport position. Furthermore, a variety of securing mechanisms can engage with the apertures formed in accessory support plate 32 to secure items thereto. For example, bungee cords or ropes can extend between first apertures 200A, 200B and second apertures 202A, 202B provide a securing force to an item on accessory support plate 32, and protrusions 210 can engage with such an item to help maintain a position of the item on accessory support plate 32.

Air compressor assembly also includes control panel 34 disposed between fluid tanks 26A, 26B. Referring in particular to FIG. 1, control panel 34 can be mounted with a rearwardly sloped orientation between fluid tanks 26A, 26B. Control panel 34 conventionally supports tank pressure gauges 230A, 230B, a regulator 232 and outlet fittings 234A, 234B. The improved readability of the tank pressure gauges 230A, 230B and the improved accessibility of regulator 232 that result from the rearwardly sloped orientation of the control panel 34 improves the accuracy with which the user is able to control the air pressure that is delivered to outlet fittings 234A, 234B.

Air compressor assembly 20 can vary in many ways. The configuration of air compressor assembly 20 can vary, and the individual components of air compressor assembly 20 can also vary. For example, the fluid tanks may have different shapes, sizes and/or orientations. In addition, the pair of fluid tanks may be replaced with a single fluid tank or a greater number of tanks. The fluid tanks can also form a part of the frame or be completely received within the frame. Moreover, it is envisioned that the accessory support plate may have a variety of configurations and may be supported by and/or coupled to other parts of the assembly, such as a non-telescoping handle or the upper fluid tank. In addition, the control panel may be disposed vertically, horizontally or at other orientations, and a variety of different configurations and types of components may be supported by the control panel. Therefore, it should be understood that air compressor assembly 20 and all of the components and configurations described herein are exemplary.

Referring to FIGS. 7-16, configurations and features of alternative air compressor assemblies and components thereof according to the principles of the present disclosure are shown. It should be understood that components of these alternative air compressor assemblies which are substantially similar to components that have been described herein will not be described in further detail. Therefore, it should be understood that descriptions herein can apply to all similar components, configurations, or features.

Referring in particular to FIGS. 7-11, air compressor assembly 1020 is shown. Air compressor assembly 1020 can have compressor mechanism 1024 oriented parallel to the fluid tanks 1026A, 1026B. Additionally, the forward facing ends of the lower sections 1148A, 1148B of the frame members 1140A, 1140B can extend below the bottom of the fluid tank 1026B to engage the surface 1162 supporting air compressor assembly 1020. Rubber feet 1160A, 1160B can be coupled to each of the forward facing ends to reduce slipping of the air compressor assembly 1020 during operation. Alternatively, this front portion of air compressor assembly 1020 can be configured as described above with reference to air compressor assembly 20.

Figure 7:
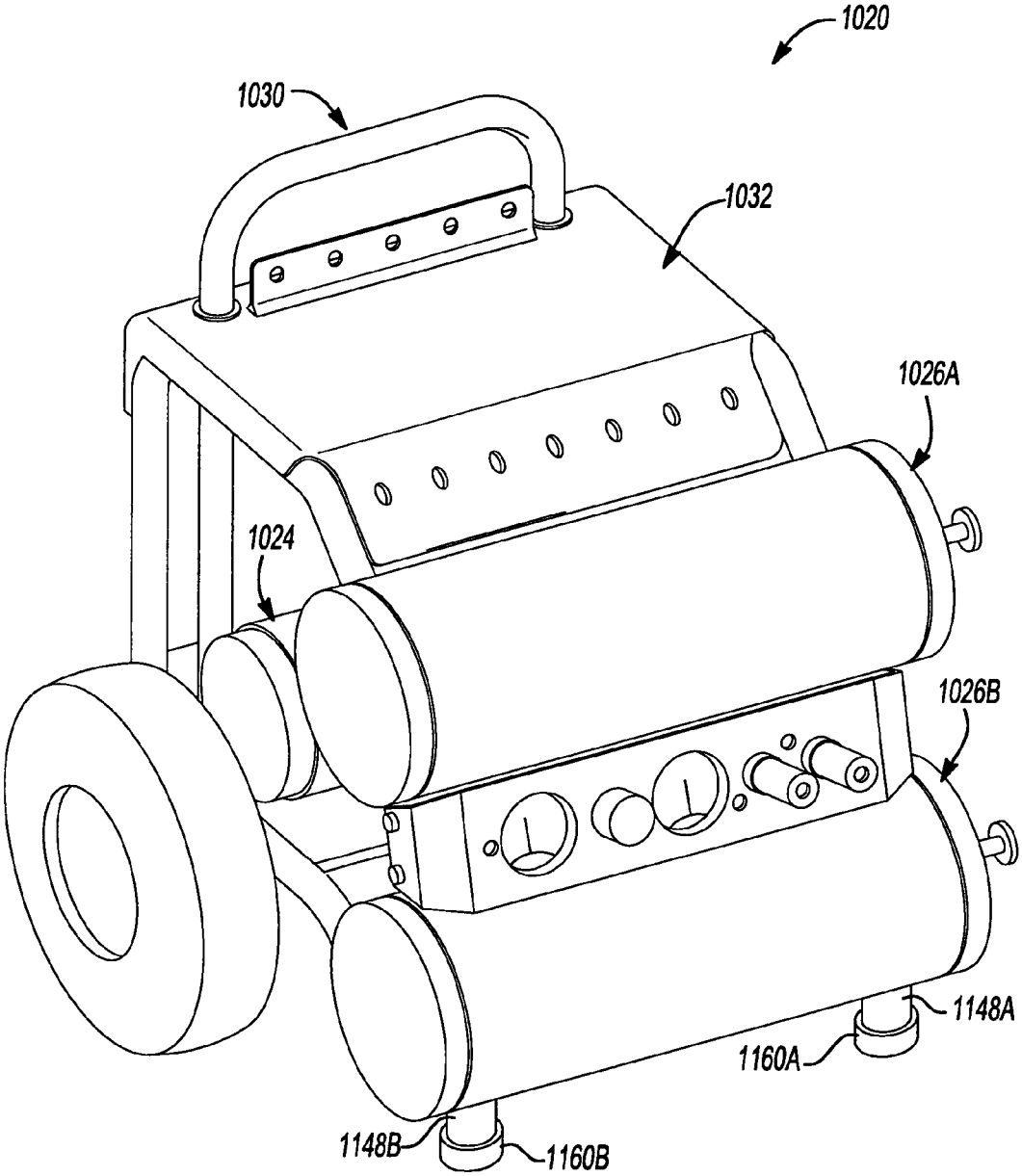
FIG. 7 is a perspective view of another air compressor assembly according to the principles of the present disclosure.

The accessory support plate 1032 is adapted to transport items. For example, as shown in FIG. 7, a flange 1250 may protrude along the rear edge of the accessory support plate 1032 to prevent items from sliding off when transporting of the air compressor assembly 1020. Alternatively, the accessory support plate 1032 may be configured with straps or belts (not shown) for securing items thereto. In this case of a strap, one end of the strap may be securely affixed on one side of the support plate; whereas, the other end of the strap may be removably attached (e.g., by tying it through an eyehole) to another area of the support plate. In the case of belts, two or more belts are securely affixed to different areas of the support plate and configured to fasten to each other. It is readily understood that other configurations for straps, belts or other securing mechanisms, such as bungee cords, may be included on the support plate.

Figure 10:
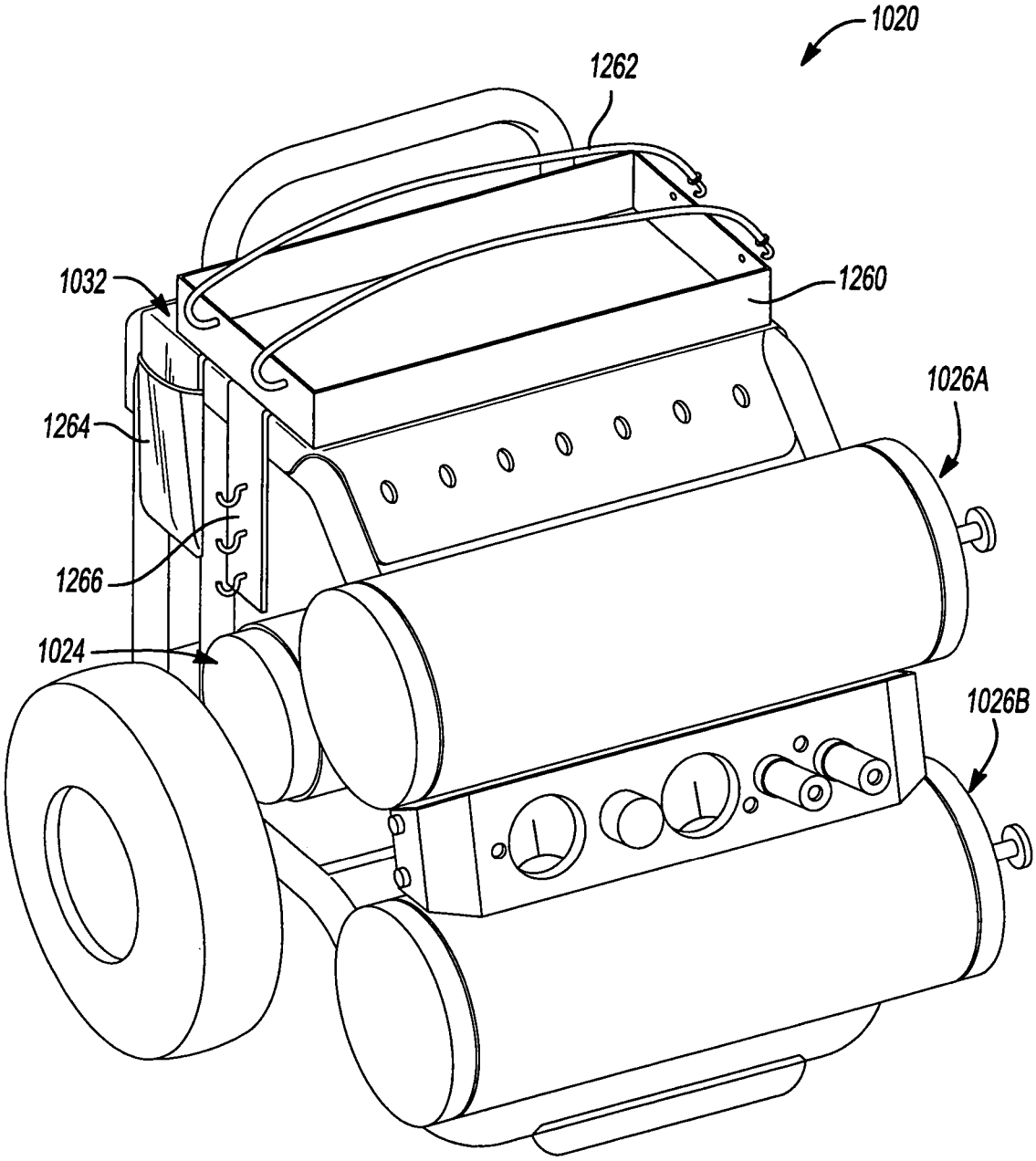
FIG. 10 is a perspective view of another air compressor assembly according to the principles of the present disclosure.
Figure 11:
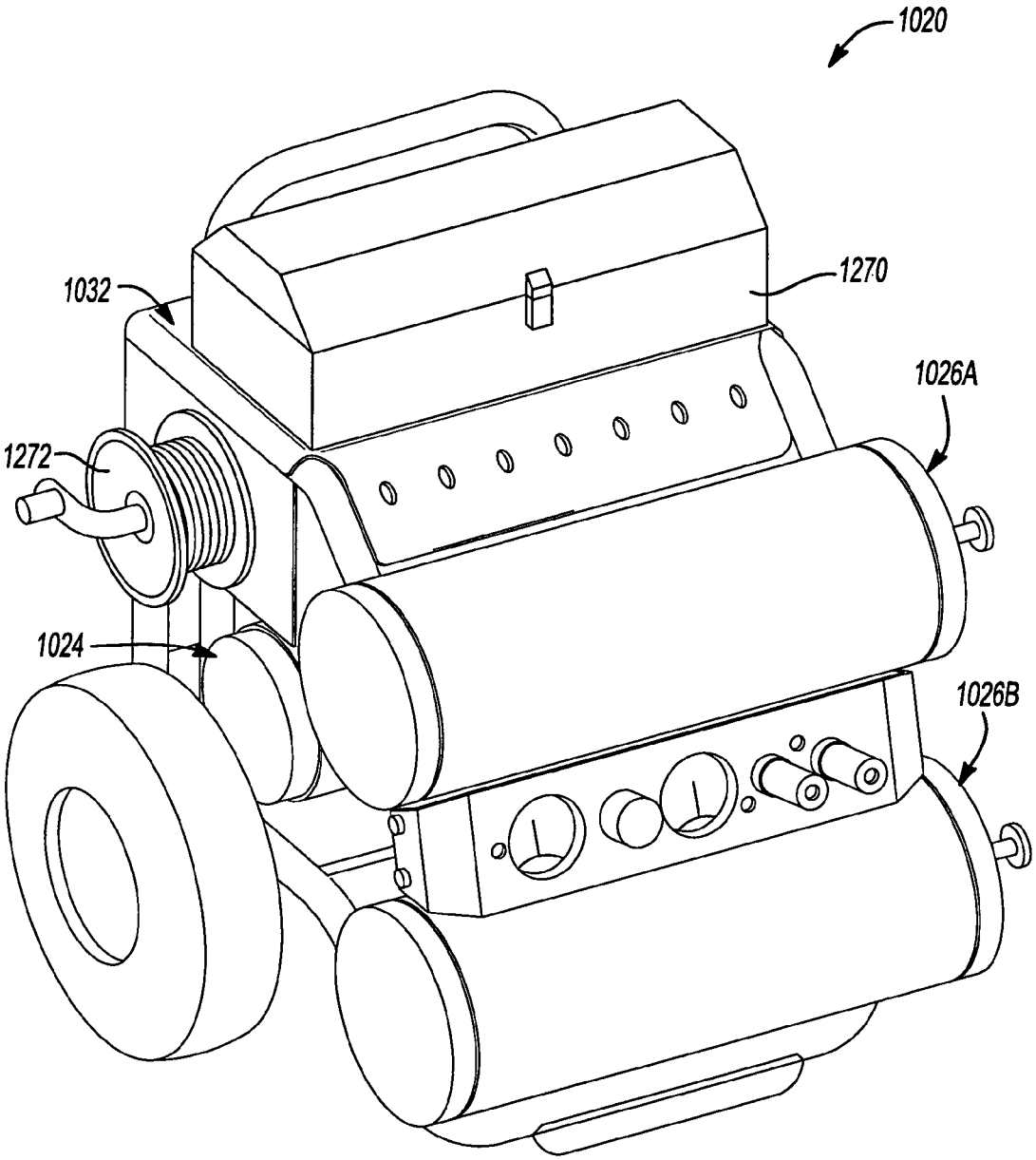
FIG. 11 is a perspective view of another air compressor assembly according to the principles of the present disclosure.

In another exemplary embodiment, the accessory support plate 1032 may have a tray 1260 disposed thereon (FIG. 10). For illustration purposes, the tray 1260 may be further configured with bungee cords 1262, a side pouch 1264, and/or a strip of carrying hooks 1266. In yet another exemplary embodiment, the accessory support plate may support an integrally formed box 1270 for storing different items (FIG. 11). The air compressor assembly 1020 may be further equipped with a reel 1272 which may be used to store a cord, a hose or other similarly wound items. Either of these exemplary embodiments may be further adapted with any of the securing mechanisms noted above.

Figure 8A:
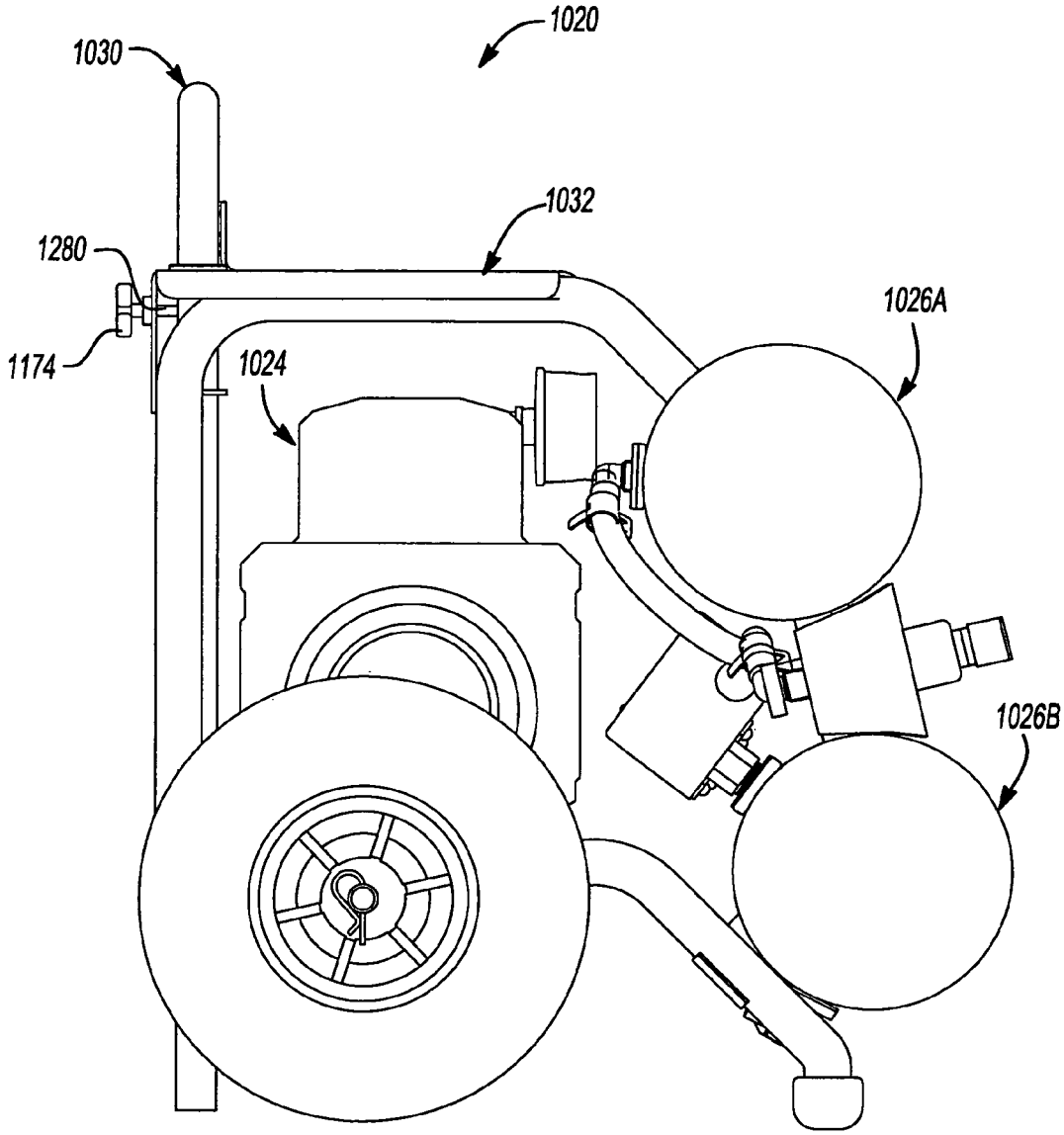
FIGS. 8A and 8B are side views of the air compressor assembly of FIG. 7 in an operational position and an exemplary transport position, respectively.
Figure 8B:
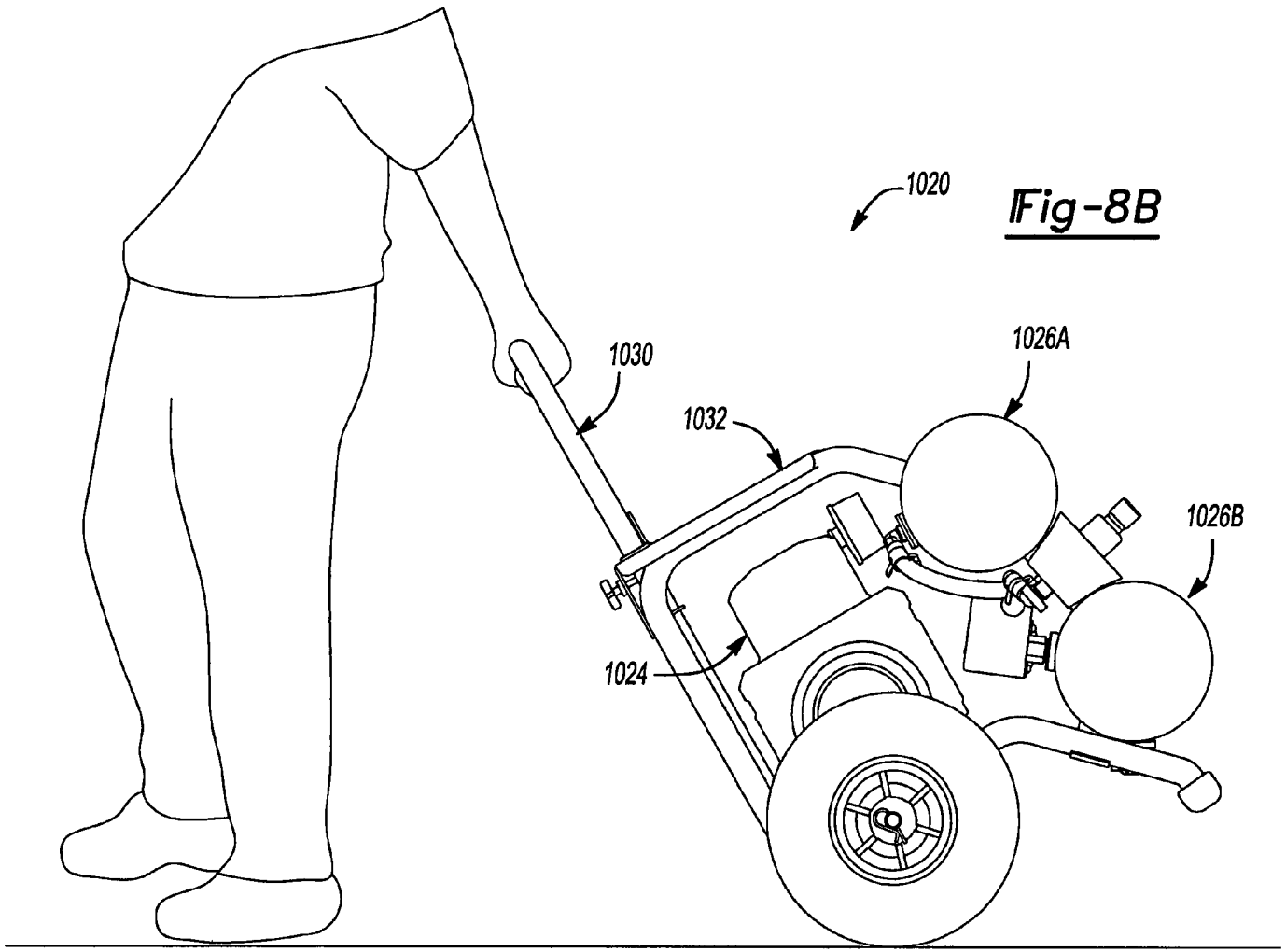
Figure 9:
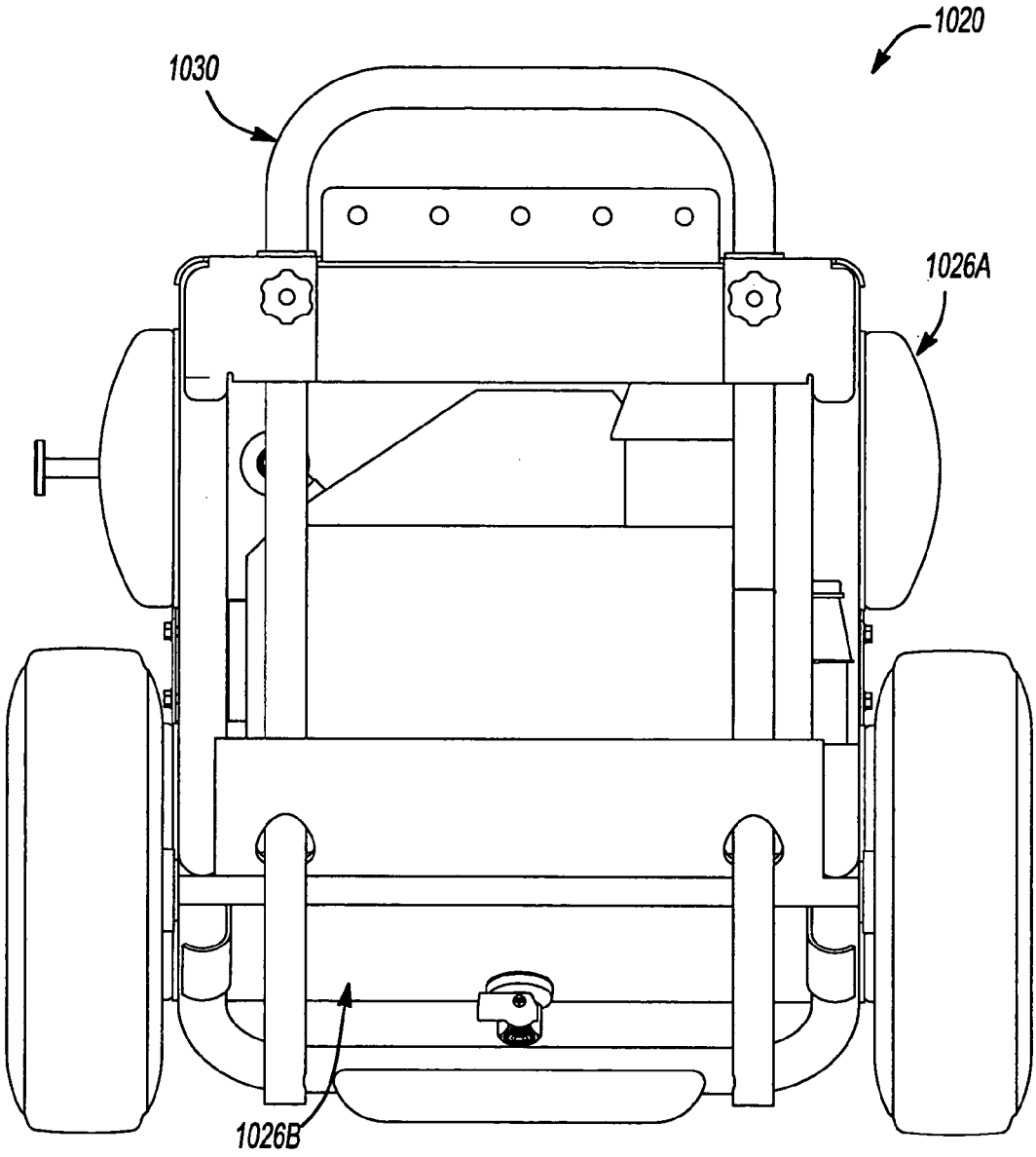
FIG. 9 is a rear view of the air compressor assembly of FIG. 7.

One or more of several mechanisms may be employed to hold the telescoping handle 1030 of air compressor assembly 1020 in an extended position. With reference to FIG. 8A, a spring loaded pin 1280 may engage one or more holes formed in the handle 1030. To extend the handle 1030 upwards, the knob 1174 affixed to the pin 1280 is pulled out by the user, thereby retracting the pin 1280 from a hole formed in an upper portion of the handle 1030. The handle 1030 is then pulled upward to an extended position. Once the pin 1280 aligns with one of the holes formed in a lower portion of the handle 1030, the knob 1174 is released and the pin 1280 is inserted into the hole, thereby locking the handle into an extended position. Alternatively, a spring loaded pin may be housed within the tubular handle (not shown), such that the pin operates in a similar manner as is commonly found on tent poles. In either case, the detent mechanism is preferably found on each downwardly extending section of the handle.

In another example, the handle slides through a sleeve having threaded holes aligned on each side. Likewise, a pass through hole is formed in the handle. When the holes in the sleeve align with the holes in the handle, a carriage bolt is threaded through the holes in the sleeve, thereby holding the handle in place.

Figure 12B:
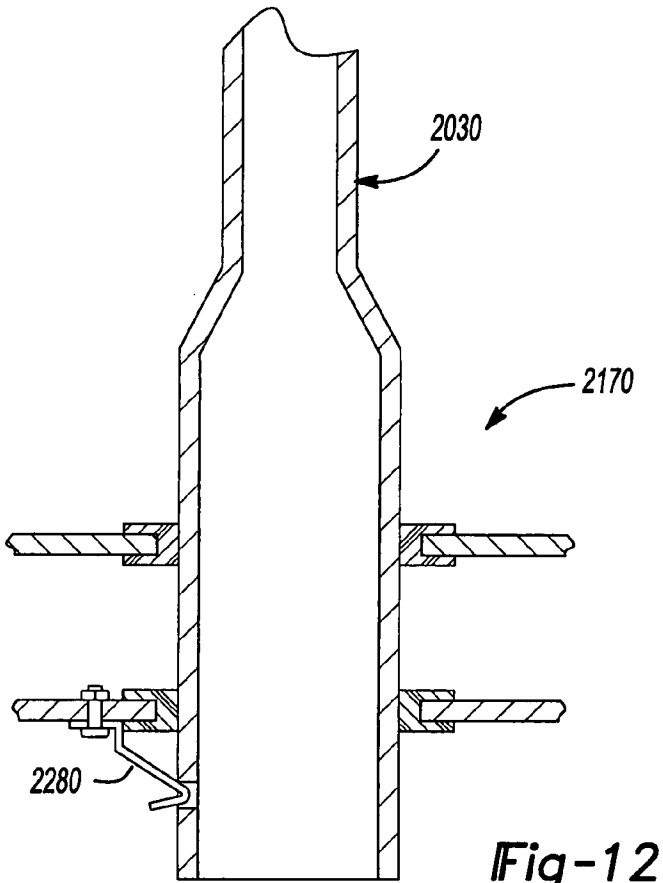
FIGS. 12A and 12B are fragmentary cross-sectional views of an exemplary handle locking mechanism according to the principles of the present disclosure.
Figure 12A:
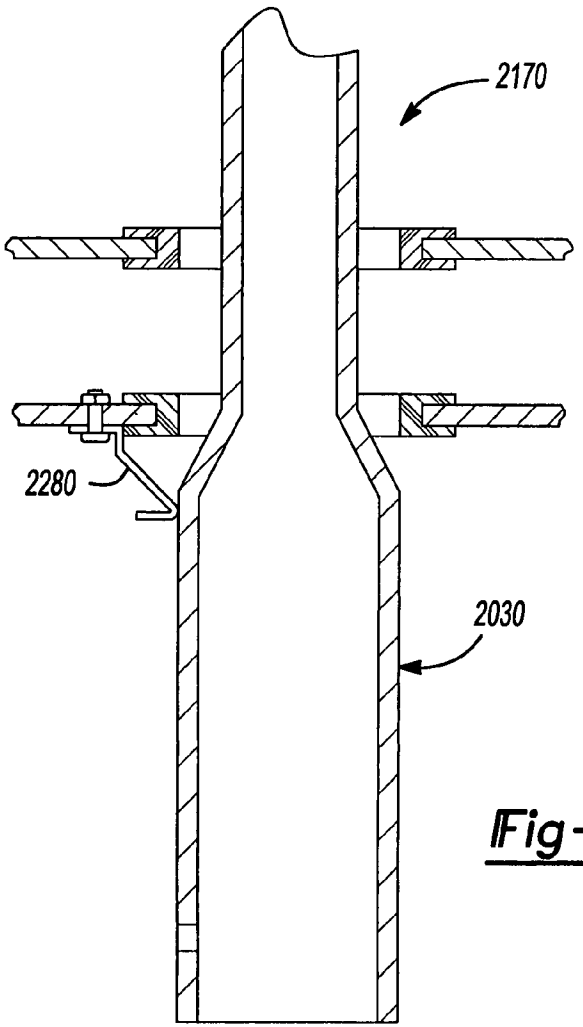

In yet another example, one or more split bushings 2170 may be used to hold the handle 2030 in an extended position as shown in FIGS. 12A and 12B. Lower sections of the handle 2030 are flared to have a larger diameter than the upper sections of the handle 2030. When the handle 2030 is pulled upward, the narrow sections of the handle 2030 allow the tubular member to slide freely. However, as the handle 2030 reaches the extended position, the flared sections of the handle 2030 will expand a pair of split bushings 2170 to create a friction fit which holds the handle 2030 in place (FIG. 12B). This embodiment may optionally employ a detent mechanism 2280 to further lock the handle 2030 in place.

Figure 13A:
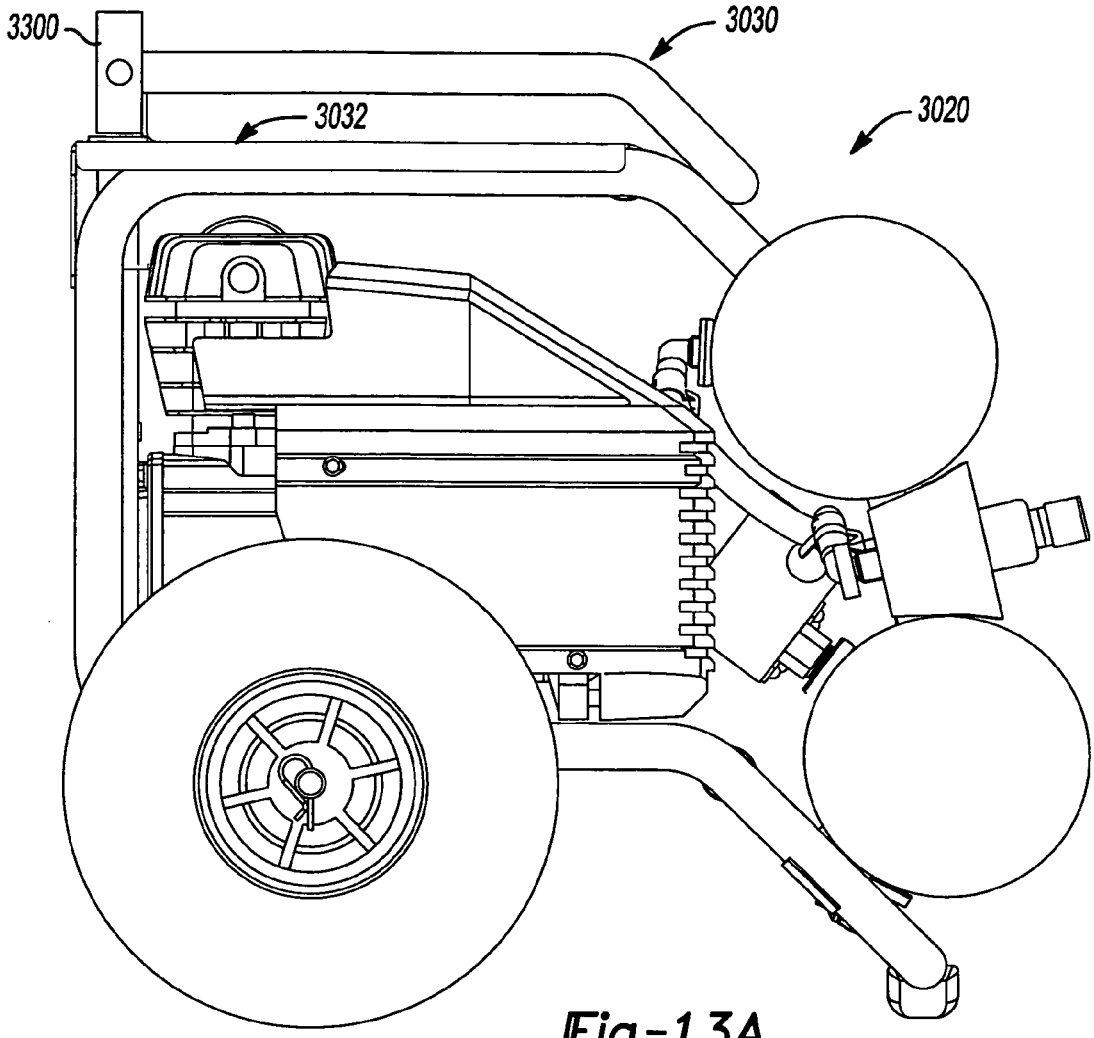
FIGS. 13A and 13C are side views of an air compressor assembly according to the principles of the present disclosure equipped with a folding handle in a stowed position and a transport position, respectively.
Figure 13B:
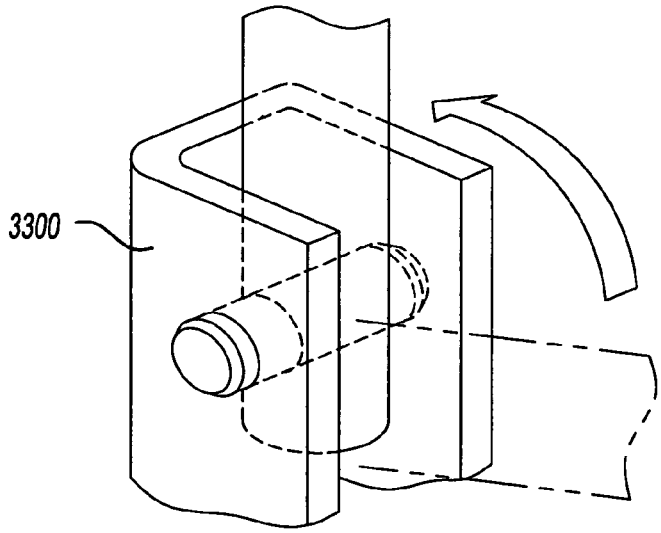
FIG. 13B is a fragmentary perspective view of the folding handle mechanism of FIGS. 13A and 13C.
Figure 13C:
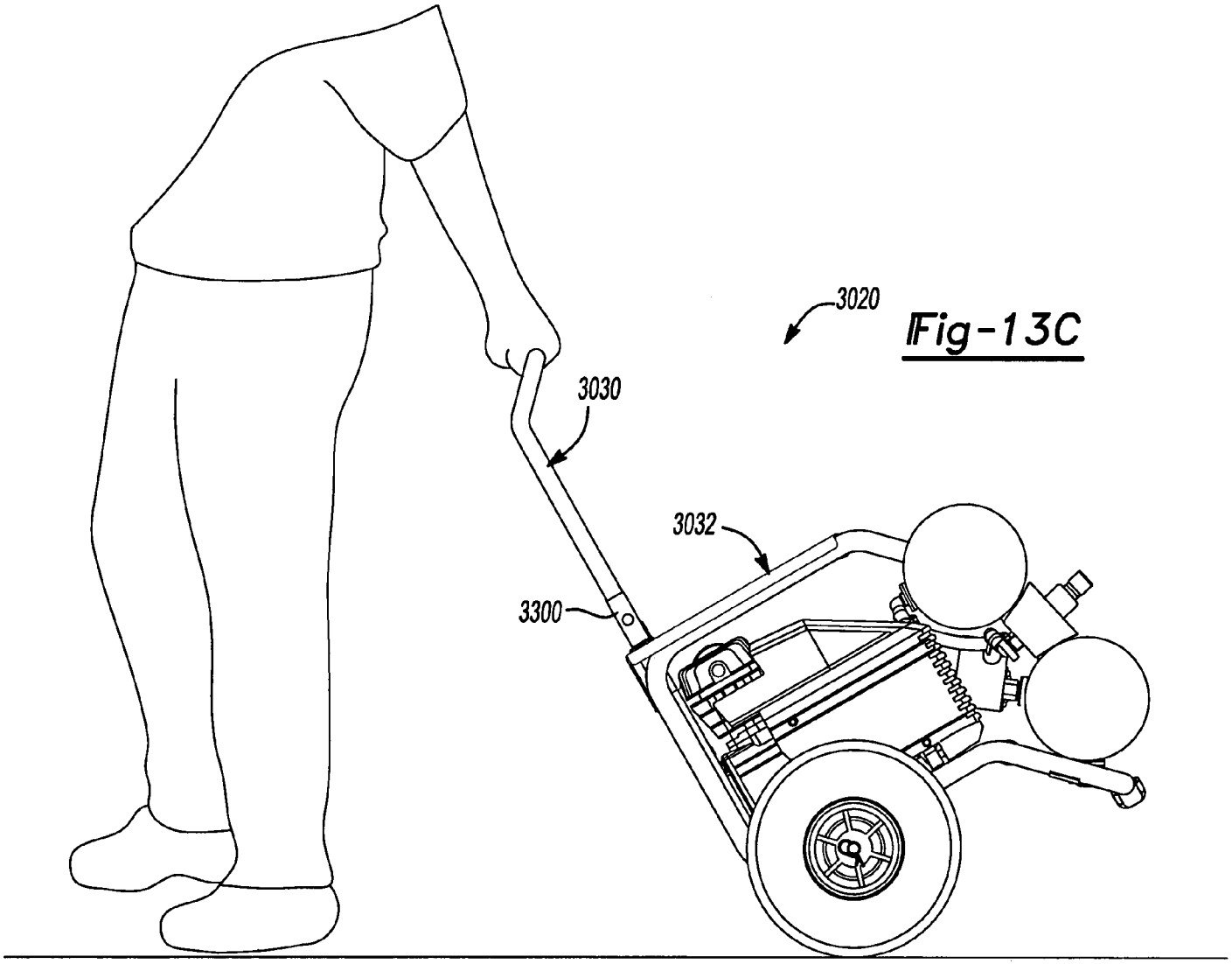

Referring to FIG. 13A-13C, air compressor assembly 3020 may employ a folding handle mechanism. In particular, air compressor assembly 3020 can include handle 3030 pivotally coupled to a sleeve 3300 which is affixed to the top of the accessory support plate 3032. In a stowed position, the handle 3030 folds down over the top of the compressor assembly as shown in FIG. 13A. To transport the compressor assembly, the handle is raised to an extended position and used to pull the assembly as shown in FIG. 13C. The air compressor assembly may include other mechanisms for providing a folding handle, such as a hinged joint or deformable plastic. Moreover, while different handle configurations have been described above, it is readily understood that other handle configurations are with the air compressor assembly.

Figure 14:
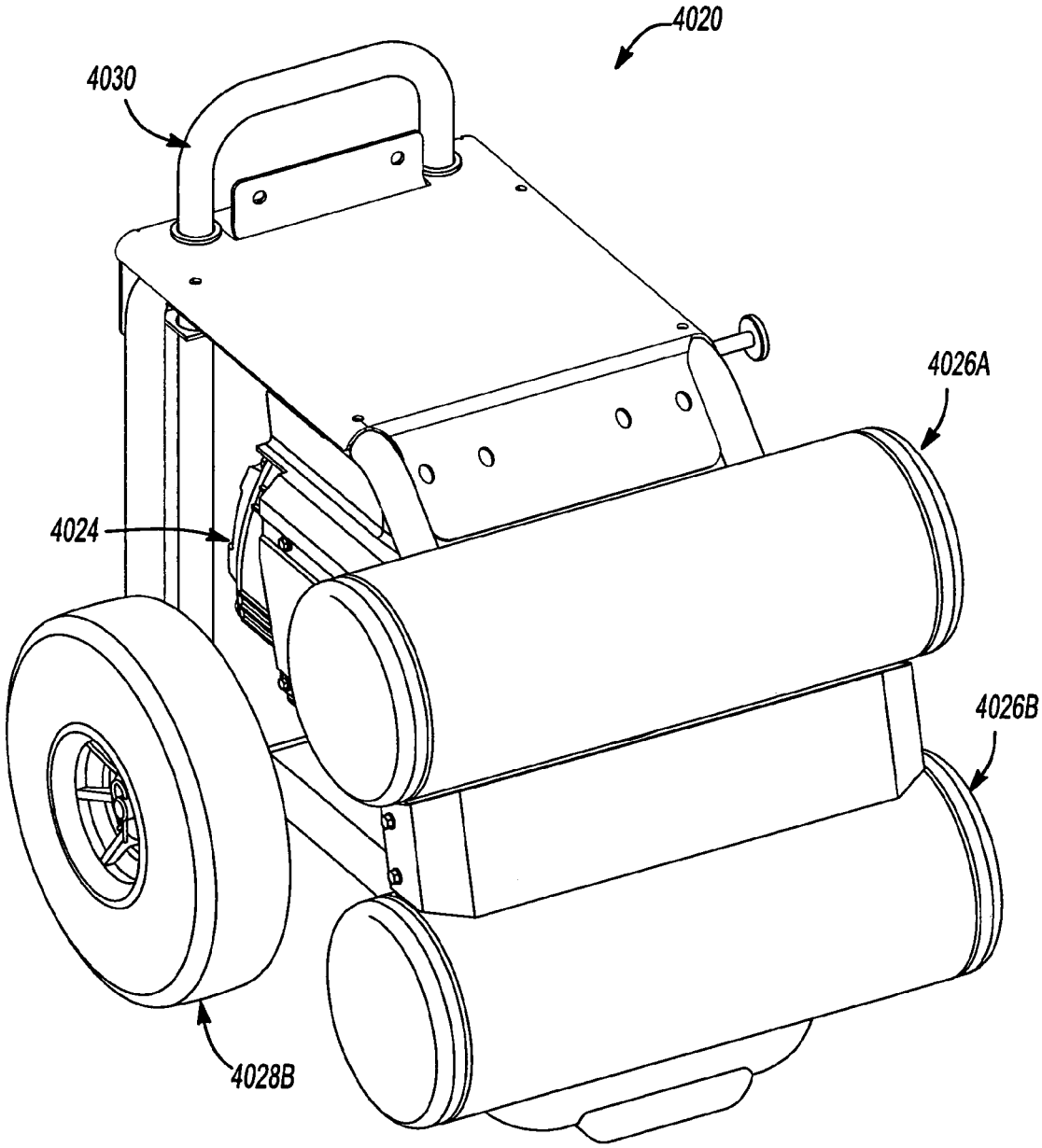
FIG. 14 is a perspective view of another air compressor assembly according to the principles of the present disclosure.
Figure 15:
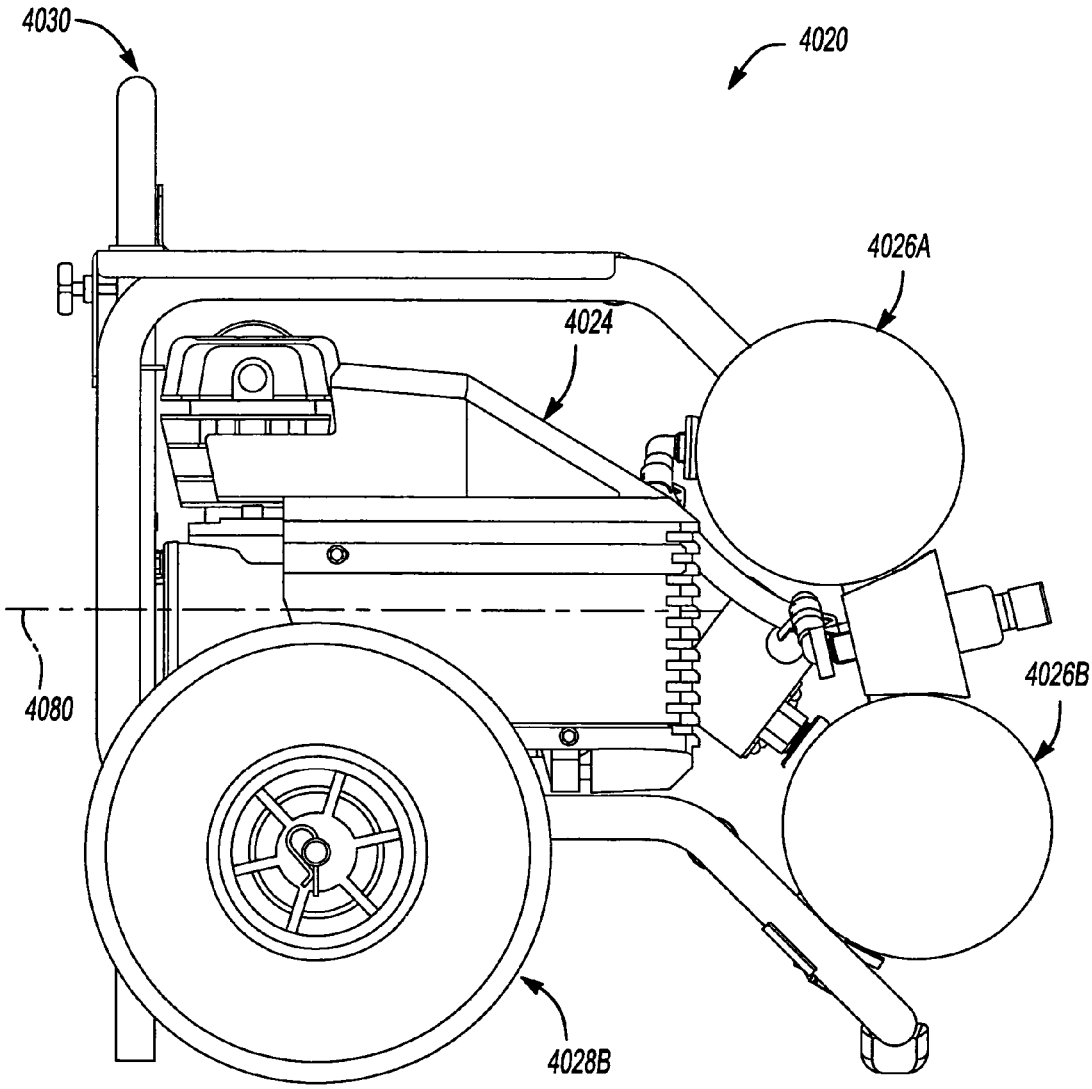
FIG. 15 is a side view of the air compressor assembly of FIG. 14.
Figure 16:
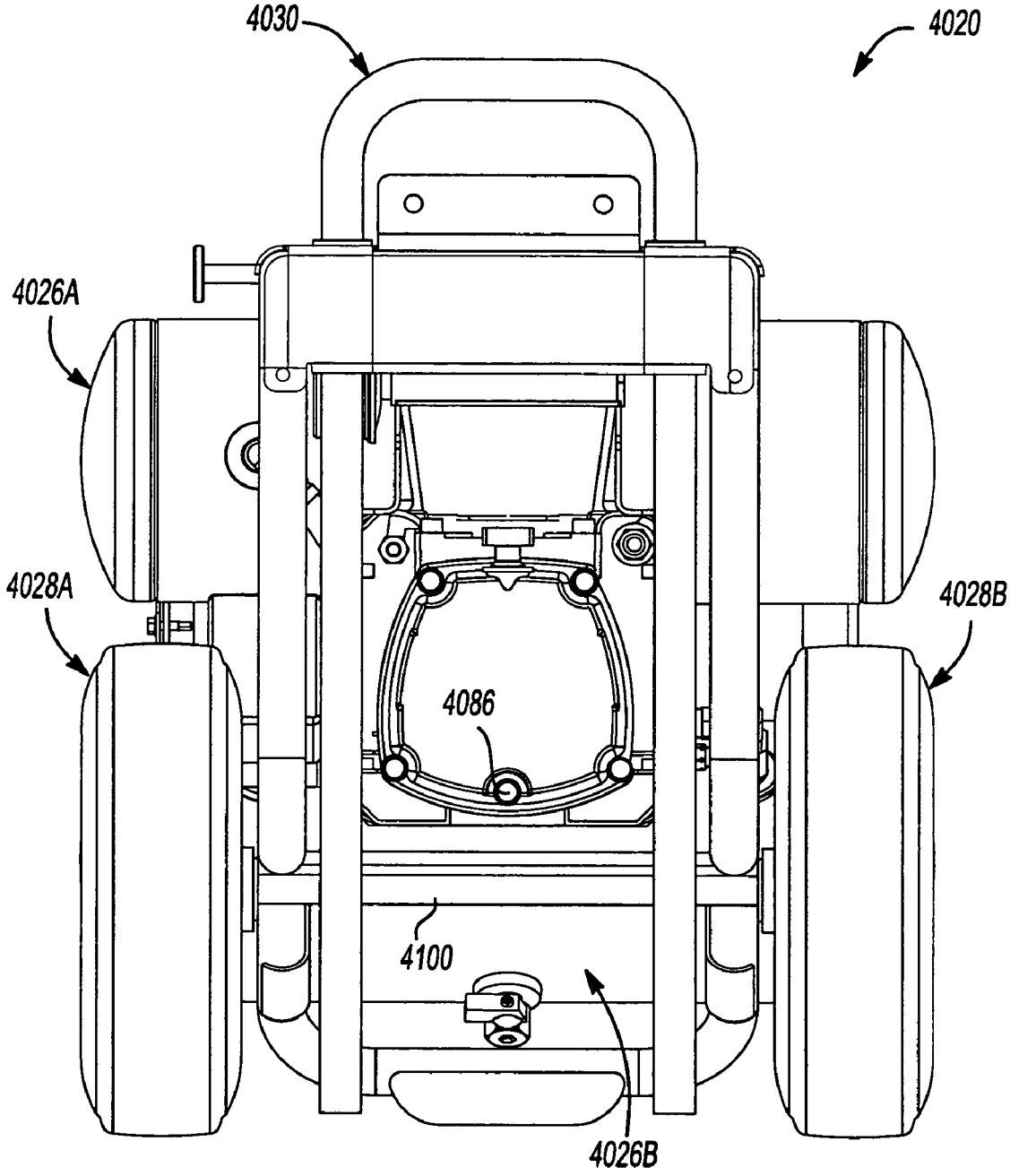
FIG. 16 is a rear view of the air compressor assembly of FIG. 14.

FIGS. 14-16 illustrate air compressor assembly 4020. Similar to air compressor assembly 20, air compressor assembly 4020 includes a longitudinal axis 4080 of the compressor mechanism 4024 is non-parallel, e.g., substantially perpendicular, to the axle 4100 of the air compressor assembly 4020. In addition, an oil drain valve 4086 for the compressor mechanism 4024 is better positioned in the center and near the rear of the air compressor assembly 4020 (FIG. 10), thereby permitting a drain pan to be more easily positioned underneath the valve as similarly describe above with reference to air compressor assembly 20. Further, the non-parallel compressor mechanism arrangement may enable placement of the wheels 4028A, 4028B closer to the front of air compressor assembly 4020, such as is similarly described above with reference to air compressor assembly 20. In other respects, air compressor assembly 4020 is substantially the same as the air compressor assemblies described above.

The disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An air compressor assembly comprising:

a support structure having a back portion and a top portion and side portions extending from said back portion in a forward direction;

a handle attached to said support structure;

a pair of wheels rotatably attached to said support structure at opposing positions proximate said side portions, said wheels being pivotable about a single rotational axis extending across said support structure in a transverse direction substantially perpendicular to said forward direction;

at least one fluid tank having a tank longitudinal axis defined therein, said at least one fluid tank being secured to said support structure with said tank longitudinal axis substantially parallel to said rotational axis of said wheels; and a compressor mechanism secured to said support structure proximate said at least one fluid tank, said compressor mechanism having a compressor longitudinal axis defined therein and being oriented on said support structure between said side portions with said compressor longitudinal axis substantially perpendicular to said tank longitudinal axis, wherein said compressor mechanism has a first end opposite said at least one fluid tank, a second end proximate said at least one fluid tank, and an oil drain proximate said first end, said compressor mechanism being positioned with said oil drain in between said rearward facing sections of said frame members.

2. The air compressor assembly of claim 1, wherein:

said support structure includes a pair of frame members each having a rearward facing section and upper and lower sections extending from said rearward facing section in said forward direction, said rearward facing sections defining said back portion of said support structure, said upper and lower sections defining said top and side portions of said support structure, said handle is disposed proximate said rearward facing sections of said frame members, said wheels are disposed proximate said lower sections of said frame members, said at least one fluid tank is secured to said support structure opposite said rearward facing sections of said frame members, and said compressor mechanism is secured to said support structure in between said at least one fluid tank and said rearward facing sections of said frame members and in between said upper and lower sections of said frame members.

3. The air compressor assembly of claim 2, wherein said at least one fluid tank has first and second ends along said tank longitudinal axis, said wheels each have an outside surface facing away from the other of said wheels, and said outside surfaces of said wheels are aligned with said ends of said at least one fluid tank.

4. The air compressor assembly of claim 3, wherein said wheels are positioned along said lower sections so as to be in between said at least one fluid tank and said handle.

5. The air compressor assembly of claim 1, comprising first and second fluid tanks having first and second tank longitudinal axes, said first fluid tank being secured to said support structure at said upper sections of said frame members opposite said rearward facing sections of said frame members, said second being secured to said support structure at said lower sections of said frame members opposite said rearward facing sections of said frame members, said first and second fluid tanks being oriented with said first and second tank longitudinal axes substantially parallel to said rotational axis of said wheels.

6. The air compressor assembly of claim 1, further comprising an accessory support plate attached to said support structure proximate said top portion.

7. The air compressor assembly of claim 6, wherein said accessory support plate includes:

a main portion extending across said top portion of said support structure in said forward direction, said handle extending through said main portion, a rear portion extending from said main portion along said back portion of said support structure in a downward direction substantially perpendicular to said forward direction, said rear portion having a pair of first apertures formed therein and spaced apart in said transverse direction, and an angled portion extending from said main portion opposite said rear portion and oriented between said forward direction and said downward direction, said angled portion having a pair of second apertures formed therein, each of said second apertures aligned with one of said first apertures.

8. The air compressor assembly of claim 7, wherein said accessory support plate further includes a grip portion extending in a rearward direction opposite said forward direction from an end of said angled portion opposite said main portion so as to be substantially parallel to said main portion, said grip portion including a pair of third apertures formed therein, each of said third apertures being aligned with one of said second apertures.

9. The air compressor assembly of claim 8, wherein said accessory support plate further includes a bottom portion extending in said forward direction from an end of said rear portion opposite said main portion so as to be substantially parallel to said main portion, and said handle further extends through said bottom portion.

10. The air compressor assembly of claim 9, wherein said accessory support plate further includes a plurality of protrusions extending outwardly from a top surface of said main portion.

11. An air compressor assembly comprising:

a support structure including a pair of frame members each having a rearward facing section and upper and lower sections extending from said rearward facing section in a forward direction, said support structure further including a front member extending between said lower sections of said frame members opposite said rearward facing sections in a transverse direction substantially perpendicular to said forward direction;

a handle attached to said support structure proximate said rearward facing sections of said frame members and defining a plane substantially parallel to a plane defined by the rearward facing sections of the frame members;

at least one fluid tank secured to said support structure;

a compressor mechanism secured to said support structure; and a pair of wheels rotatable about a single rotational axis and being rotatably attached to said support structure at opposing positions proximate said lower sections of said frame members, the wheels positioned along the lower sections of the frame member forward of the plane defined by the handle and between said rearward facing sections of said frame members and said front member of said support structure so that said rotational axis is in between said handle and said front member of said support structure, said rotational axis being oriented substantially parallel to said transverse direction, wherein the air compressor assembly has an operational position in which the air compressor assembly is supported by said wheels and said front member of said support structure, and the air compressor assembly is pivotable from said operational position about said rotational axis of said wheels to a transport position in which the air compressor is supported only by said wheels so as to be movable.

12. The air compressor assembly of claim 11, wherein:

said at least one fluid tank has a tank longitudinal axis defined therein and first and second ends along said tank longitudinal axis, said at least one fluid tank being secured to said support structure opposite said rearward facing sections of said frame members, said at least one fluid tank being oriented with said tank longitudinal axis substantially parallel to said rotational axis of said wheels, and said compressor mechanism has a compressor longitudinal axis defined therein and first and second ends along said compressor longitudinal axis, said compressor mechanism being secured to said support structure in between said at least one fluid tank and said rearward facing sections of said frame members and in between said upper and lower sections of said frame members, said compressor mechanism being oriented on said support structure with said second end proximate said at least one fluid tank and said compressor longitudinal axis substantially perpendicular to said tank longitudinal axis.

13. The air compressor assembly of claim 12, wherein:

said at least one fluid tank has a fluid drain disposed between said ends thereof, said fluid drain being angled between a rearward direction opposite said forward direction and a downward direction substantially perpendicular to said forward direction defined from said upper sections of said frame members to said lower sections, and said compressor mechanism has an oil drain disposed proximate said first end.

14. The air compressor assembly of claim 13, wherein:

said frame members of said support structure each have an elbow defined between said rearward facing sections and said lower sections, and the air compressor assembly has a drain position in which the air compressor assembly is supported by said wheels and said elbows so as to facilitate operation of said fluid drain and said oil drain.

15. The air compressor assembly of claim 14, wherein said fluid drain is oriented substantially parallel to said downward direction in the drain position of the air compressor assembly.

16. The air compressor assembly of claim 12, wherein said wheels are attached to said support structure so as to be in between said handle and said front member of said support structure.

17. The air compressor assembly of claim 16, wherein said wheels are attached to said support structure so as to be in between said handle and said at least one fluid tank.

18. The air compressor assembly of claim 12, wherein said wheels each have an outside surface facing away from the other of said wheels, and said outside surfaces of said wheels are aligned with said ends of said at least one fluid tank.

19. The air compressor assembly of claim 11, further comprising an accessory support plate attached to said support structure between said upper sections of said frame members.

20. The air compressor assembly of claim 19, wherein said accessory support plate includes:

a main portion extending between said upper sections of said frame members in said forward direction, said handle extending through said main portion, a rear portion extending from said main portion along said rearward facing sections of said frame members in a downward direction substantially perpendicular to said forward direction, said rear portion having a pair of first apertures formed therein and spaced apart in said transverse direction, and an angled portion extending from said main portion opposite said rear portion and oriented between said forward direction and said downward direction, said angled portion having a pair of second apertures formed therein, each of said second apertures being aligned with one of said first apertures.

21. The air compressor assembly of claim 20, wherein said accessory support plate further includes a grip portion extending in a rearward direction opposite said forward direction from an end of said angled portion opposite said main portion so as to be substantially parallel to said main portion, said grip portion including a pair of third apertures formed therein, each of said third apertures being aligned with one of said second apertures.

22. The air compressor assembly of claim 21, wherein said accessory support plate further includes a bottom portion extending in said forward direction from an end of said rear portion opposite said main portion so as to be substantially parallel to said main portion, and said handle further extends through said bottom portion.

23. The air compressor assembly of claim 22, wherein said accessory support plate further includes a plurality of protrusions extending outwardly from a top surface of said main portion.

24. An air compressor assembly comprising:

a support structure including a pair of frame members each having a rearward facing section and upper and lower sections extending from said rearward facing section in a forward direction;

a handle attached to said support structure proximate said rearward facing sections of said frame members;

at least one fluid tank secured to said support structure;

a compressor mechanism secured to said support structure;

a pair of wheels rotatably attached to said support structure at opposing positions proximate said lower sections of said frame members, the wheels positioned along the lower sections of the frame members forward of the handle; and an accessory support plate secured to said support structure in between said upper sections of said frame members, said accessory support plate having a back section proximate said rearward facing sections of said frame members and a front section opposite said back section, said accessory support plate including a pair of first apertures and a pair of second apertures formed therein, said first apertures being spaced apart and disposed proximate said back section, said second apertures being spaced apart and disposed proximate said front section, each of said second apertures being aligned with one of said first apertures, wherein said accessory support plate further includes:

a main portion extending between said upper sections of said frame members and having a first end proximate said rearward facing sections and a second end opposite said first end, a rear portion extending from said first end of said main portion along said rearward facing sections of said frame members toward said lower sections, said first apertures being formed in said rear portion, and an angled portion extending from said second end of said main portion, said angled portion being oriented between a direction away from said rearward facing sections of said frame members and a direction towards said lower sections, said second apertures being formed in said angled portion.

25. The air compressor assembly of claim 24, wherein said accessory support plate further includes a grip portion extending from an end of said angled portion opposite said main portion, said grip portion extending towards said rearward facing sections of said frame members, said grip portion having a pair of third apertures formed therein, each of said third apertures being aligned with one of said second apertures, wherein said third apertures are adapted for removably engaging with securing mechanisms for securing items on said accessory support plate.

26. The air compressor assembly of claim 25, wherein said accessory support plate further includes a bottom portion extending from an end of said rear portion opposite said main portion in said direction away from said rearward facing sections of said frame members so as to be substantially parallel to said main portion.

27. The air compressor assembly of claim 26, wherein said handle extends through said main portion and said bottom portion of said accessory support plate.

28. The air compressor assembly of claim 24, wherein said first and second apertures are aligned along said direction away from said rearward facing sections of said frame members.

29. The air compressor assembly of claim 24, wherein said main portion of said accessory support plate has an outer surface including a plurality of protrusions extending therefrom.

* * * * *